US009747911B2

(12) United States Patent
Peters et al.

(10) Patent No.: US 9,747,911 B2
(45) **Date of Patent: *Aug. 29, 2017**

(54) REUSE OF SYNTAX ELEMENT INDICATING VECTOR QUANTIZATION CODEBOOK USED IN COMPRESSING VECTORS

(71) Applicant: QUALCOMM Incorporated, San Diego, CA (US)

(72) Inventors: Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/290,206

(22) Filed: Oct. 11, 2016

(65) Prior Publication Data

US 2017/0032797 A1 Feb. 2, 2017

Related U.S. Application Data

(63) Continuation of application No. 14/609,190, filed on Jan. 29, 2015, now Pat. No. 9,489,955.
(Continued)

(51) Int. Cl.
*G10L 19/00* (2013.01)
*G10L 19/038* (2013.01)
(Continued)

(52) U.S. Cl.
CPC ..... *G10L 19/038* (2013.01); *G10L 19/002* (2013.01); *G10L 19/008* (2013.01);
(Continued)

(58) Field of Classification Search
USPC ..... 704/200–232, 500–504
See application file for complete search history.

(56) References Cited

U.S. PATENT DOCUMENTS 4,709,340 A 11/1987 Capizzi et al.
5,012,518 A 4/1991 Liu et al.
(Continued)

FOREIGN PATENT DOCUMENTS

CN 102823277 A 12/2012
CN 104285390 A 1/2015
(Continued)

OTHER PUBLICATIONS

"Call for Proposals for 3D Audio," International Organisation for Standardisation Organisation Internationale de Normalisation ISO/IEC JTC1/SC29/WG11 Coding of Moving Pictures and Audio, ISO/IEC JTC1/SC29/WG11/N13411, Geneva, Jan. 2013, 20 pp.
(Continued)

*Primary Examiner* — Jesse Pullias
(74) *Attorney, Agent, or Firm* — Shumaker & Sieffert, P.A.

(57) ABSTRACT

In general, techniques are described for indicating reuse of a syntax element indicating a vector quantization codebook used in compressing a vector. A device comprising a processor and a memory may perform the techniques. The processor may be configured to obtain a bitstream comprising a vector in a spherical harmonics domain. The bitstream may further comprise an indicator for whether to reuse, from a previous frame, a syntax element indicative of a vector quantization codebook used when compressing the vector. The memory may be configured to store the bitstream.

28 Claims, 10 Drawing Sheets

Related U.S. Application Data

(60) Provisional application No. 61/933,706, filed on Jan. 30, 2014, provisional application No. 61/933,714, filed on Jan. 30, 2014, provisional application No. 61/933,731, filed on Jan. 30, 2014, provisional application No. 61/949,591, filed on Mar. 7, 2014, provisional application No. 61/949,583, filed on Mar. 7, 2014, provisional application No. 61/994,794, filed on May 16, 2014, provisional application No. 62/004,147, filed on May 28, 2014, provisional application No. 62/004,067, filed on May 28, 2014, provisional application No. 62/004,128, filed on May 28, 2014, provisional application No. 62/019,663, filed on Jul. 1, 2014, provisional application No. 62/027,702, filed on Jul. 22, 2014, provisional application No. 62/028,282, filed on Jul. 23, 2014, provisional application No. 62/029,173, filed on Jul. 25, 2014, provisional application No. 62/032,440, filed on Aug. 1, 2014, provisional application No. 62/056,248, filed on Sep. 26, 2014, provisional application No. 62/056,286, filed on Sep. 26, 2014, provisional application No. 62/102,243, filed on Jan. 12, 2015.

(51) Int. Cl.

| | |
|---|---|
| ***G10L 19/008*** | (2013.01) |
| ***G10L 19/002*** | (2013.01) |
| ***G10L 19/08*** | (2013.01) |
| ***H04S 3/00*** | (2006.01) |
| ***H04S 7/00*** | (2006.01) |
| ***H04R 5/00*** | (2006.01) |
| ***G10L 19/20*** | (2013.01) |

(52) U.S. Cl.

CPC ..... *G10L 19/08* (2013.01); *G10L 19/20* (2013.01); *H04R 5/00* (2013.01); *H04S 3/002* (2013.01); *H04S 7/30* (2013.01); *G10L 2019/0001* (2013.01); *H04R 2499/15* (2013.01); *H04S 2400/01* (2013.01); *H04S 2420/11* (2013.01)

(56) References Cited

U.S. PATENT DOCUMENTS

| | | | |
|---|---|---|---|
| 5,633,981 | A | 5/1997 | Davis |
| 5,757,927 | A | 5/1998 | Gerzon et al. |
| 5,790,759 | A | 8/1998 | Chen |
| 5,819,215 | A | 10/1998 | Dobson et al. |
| 5,821,887 | A | 10/1998 | Zhu |
| 5,970,443 | A | 10/1999 | Fujii |
| 6,167,375 | A | 12/2000 | Miseki et al. |
| 6,263,312 | B1 | 7/2001 | Kolesnik et al. |
| 6,370,502 | B1 | 4/2002 | Wu et al. |
| 7,271,747 | B2 | 9/2007 | Baraniuk et al. |
| 7,822,601 | B2 | 10/2010 | Mehrotra et al. |
| 7,920,709 | B1 | 4/2011 | Hickling |
| 8,160,269 | B2 | 4/2012 | Mao et al. |
| 8,374,358 | B2 | 2/2013 | Buck et al. |
| 8,379,868 | B2 | 2/2013 | Goodwin et al. |
| 8,391,500 | B2 | 3/2013 | Hannemann et al. |
| 8,452,587 | B2 | 5/2013 | Liu et al. |
| 8,570,291 | B2 | 10/2013 | Motomura et al. |
| 8,817,991 | B2 | 8/2014 | Jaillet et al. |
| 8,908,873 | B2 | 12/2014 | Herre et al. |
| 8,958,582 | B2 | 2/2015 | Yoo et al. |
| 8,964,994 | B2 | 2/2015 | Jaillet et al. |
| 9,015,051 | B2 | 4/2015 | Pulkki |
| 9,053,697 | B2 | 6/2015 | Park et al. |
| 9,084,049 | B2 | 7/2015 | Fielder et al. |
| 9,100,768 | B2 | 8/2015 | Batke et al. |
| 9,113,281 | B2 | 8/2015 | Jin et al. |
| 9,129,597 | B2 | 9/2015 | Bayer et al. |
| 9,230,558 | B2 | 1/2016 | Disch et al. |
| 9,338,574 | B2 | 5/2016 | Jax et al. |
| 9,454,971 | B2 | 9/2016 | Kruger et al. |
| 9,466,305 | B2 | 10/2016 | Sen et al. |
| 9,489,955 | B2 | 11/2016 | Peters et al. |
| 9,495,968 | B2 | 11/2016 | Sen et al. |
| 9,502,044 | B2 | 11/2016 | Peters et al. |
| 9,502,045 | B2 | 11/2016 | Peters et al. |
| 2001/0036286 | A1 | 11/2001 | Layton et al. |
| 2002/0044605 | A1 | 4/2002 | Nakamura |
| 2002/0049586 | A1 | 4/2002 | Nishio et al. |
| 2002/0169735 | A1 | 11/2002 | Kil et al. |
| 2003/0147539 | A1 | 8/2003 | Elko et al. |
| 2003/0179197 | A1 | 9/2003 | Sloan et al. |
| 2004/0131196 | A1 | 7/2004 | Malham |
| 2004/0158461 | A1 | 8/2004 | Ramabadran et al. |
| 2005/0053130 | A1 | 3/2005 | Jabri et al. |
| 2005/0074135 | A1 | 4/2005 | Kushibe |
| 2006/0045291 | A1 | 3/2006 | Smith |
| 2006/0126852 | A1 | 6/2006 | Bruno et al. |
| 2006/0282874 | A1 | 12/2006 | Ito et al. |
| 2007/0009115 | A1 | 1/2007 | Reining et al. |
| 2007/0094019 | A1 | 4/2007 | Nurminen |
| 2007/0172071 | A1 | 7/2007 | Mehrotra et al. |
| 2008/0004729 | A1 | 1/2008 | Hiipakka |
| 2008/0137870 | A1 | 6/2008 | Nicol et al. |
| 2008/0143719 | A1 | 6/2008 | Zhou et al. |
| 2008/0205676 | A1 | 8/2008 | Merimaa et al. |
| 2008/0306720 | A1 | 12/2008 | Nicol et al. |
| 2009/0006103 | A1 | 1/2009 | Koishida et al. |
| 2009/0092259 | A1 | 4/2009 | Jot et al. |
| 2009/0248425 | A1 | 10/2009 | Vetterli et al. |
| 2010/0085247 | A1 | 4/2010 | Venkatraman et al. |
| 2010/0092014 | A1 | 4/2010 | Strauss et al. |
| 2010/0198585 | A1 | 8/2010 | Mouhssine et al. |
| 2010/0329466 | A1 | 12/2010 | Berge |
| 2011/0164466 | A1 | 7/2011 | Hald |
| 2011/0224995 | A1 | 9/2011 | Kovesi et al. |
| 2011/0249738 | A1 | 10/2011 | Suzuki et al. |
| 2011/0249821 | A1 | 10/2011 | Jaillet et al. |
| 2011/0249822 | A1 | 10/2011 | Jaillet et al. |
| 2011/0261973 | A1 | 10/2011 | Nelson et al. |
| 2011/0305344 | A1 | 12/2011 | Sole et al. |
| 2012/0014527 | A1 | 1/2012 | Furse |
| 2012/0093344 | A1 | 4/2012 | Sun et al. |
| 2012/0128160 | A1 | 5/2012 | Kim et al. |
| 2012/0155653 | A1 | 6/2012 | Jax et al. |
| 2012/0163622 | A1 | 6/2012 | Karthik et al. |
| 2012/0174737 | A1 | 7/2012 | Risan |
| 2012/0177234 | A1* | 7/2012 | Rank ..... G10L 19/04 381/314 |
| 2012/0243692 | A1 | 9/2012 | Ramamoorthy |
| 2012/0257579 | A1 | 10/2012 | Li et al. |
| 2012/0259442 | A1 | 10/2012 | Jin et al. |
| 2012/0271629 | A1 | 10/2012 | Sung et al. |
| 2012/0314878 | A1 | 12/2012 | Daniel et al. |
| 2013/0010971 | A1 | 1/2013 | Batke et al. |
| 2013/0028427 | A1 | 1/2013 | Yamamoto et al. |
| 2013/0041658 | A1 | 2/2013 | Bradley et al. |
| 2013/0064375 | A1 | 3/2013 | Atkins et al. |
| 2013/0148812 | A1 | 6/2013 | Corteel et al. |
| 2013/0216070 | A1* | 8/2013 | Keiler ..... G10L 19/008 381/300 |
| 2013/0223658 | A1 | 8/2013 | Betlehem et al. |
| 2013/0320804 | A1 | 12/2013 | Symko et al. |
| 2014/0016784 | A1 | 1/2014 | Sen et al. |
| 2014/0016786 | A1 | 1/2014 | Sen |
| 2014/0016802 | A1 | 1/2014 | Sen |
| 2014/0023197 | A1 | 1/2014 | Xiang et al. |
| 2014/0025386 | A1 | 1/2014 | Xiang et al. |
| 2014/0029758 | A1 | 1/2014 | Nakadai et al. |
| 2014/0133660 | A1 | 5/2014 | Jax et al. |
| 2014/0219455 | A1 | 8/2014 | Peters et al. |
| 2014/0226823 | A1 | 8/2014 | Sen et al. |
| 2014/0233762 | A1 | 8/2014 | Vilkamo et al. |
| 2014/0233917 | A1 | 8/2014 | Xiang |
| 2014/0247946 | A1 | 9/2014 | Sen et al. |

(56) References Cited

U.S. PATENT DOCUMENTS

| | | | |
|---|---|---|---|
| 2014/0270245 | A1 | 9/2014 | Elko et al. |
| 2014/0286493 | A1 | 9/2014 | Kordon et al. |
| 2014/0307894 | A1 | 10/2014 | Kordon et al. |
| 2014/0355766 | A1 | 12/2014 | Morrell et al. |
| 2014/0355769 | A1 | 12/2014 | Peters et al. |
| 2014/0355770 | A1 | 12/2014 | Peters et al. |
| 2014/0358266 | A1 | 12/2014 | Peters et al. |
| 2014/0358557 | A1 | 12/2014 | Sen et al. |
| 2014/0358558 | A1 | 12/2014 | Sen et al. |
| 2014/0358559 | A1 | 12/2014 | Sen et al. |
| 2014/0358560 | A1 | 12/2014 | Sen et al. |
| 2014/0358561 | A1 | 12/2014 | Sen et al. |
| 2014/0358562 | A1 | 12/2014 | Sen et al. |
| 2014/0358563 | A1 | 12/2014 | Sen et al. |
| 2014/0358564 | A1 | 12/2014 | Sen et al. |
| 2014/0358565 | A1 | 12/2014 | Peters et al. |
| 2014/0358567 | A1 | 12/2014 | Koppens et al. |
| 2015/0098572 | A1* | 4/2015 | Krueger ..... G10L 19/008 381/22 |
| 2015/0127354 | A1 | 5/2015 | Peters et al. |
| 2015/0154965 | A1 | 6/2015 | Wuebbolt et al. |
| 2015/0154971 | A1* | 6/2015 | Boehm ..... G10L 19/008 704/500 |
| 2015/0163615 | A1 | 6/2015 | Boehm et al. |
| 2015/0213803 | A1 | 7/2015 | Peters et al. |
| 2015/0213805 | A1 | 7/2015 | Peters et al. |
| 2015/0213809 | A1 | 7/2015 | Peters et al. |
| 2015/0264483 | A1 | 9/2015 | Morrell et al. |
| 2015/0264484 | A1 | 9/2015 | Peters et al. |
| 2015/0287418 | A1 | 10/2015 | Vasilache et al. |
| 2015/0332679 | A1 | 11/2015 | Kruger et al. |
| 2015/0332690 | A1 | 11/2015 | Kim et al. |
| 2015/0332691 | A1 | 11/2015 | Kim et al. |
| 2015/0332692 | A1 | 11/2015 | Kim et al. |
| 2015/0341736 | A1 | 11/2015 | Peters et al. |
| 2015/0358631 | A1 | 12/2015 | Zhang et al. |
| 2015/0371633 | A1 | 12/2015 | Chelba |
| 2015/0380002 | A1 | 12/2015 | Uhle et al. |
| 2016/0088415 | A1 | 3/2016 | Krueger et al. |
| 2016/0093308 | A1 | 3/2016 | Kim |
| 2016/0093311 | A1 | 3/2016 | Kim |
| 2016/0155448 | A1 | 6/2016 | Purnhagen et al. |
| 2016/0174008 | A1 | 6/2016 | Boehm |
| 2016/0366530 | A1 | 12/2016 | Peters et al. |
| 2016/0381482 | A1 | 12/2016 | Peters |
| 2017/0032798 | A1 | 2/2017 | Peters |

FOREIGN PATENT DOCUMENTS

| | | | |
|---|---|---|---|
| EP | 2234104 | A1 | 9/2010 |
| EP | 2450880 | A1 | 5/2012 |
| EP | 2469741 | A1 | 6/2012 |
| EP | 2665208 | A1 | 11/2013 |
| EP | 2765791 | A1 | 8/2014 |
| EP | 2954700 | A1 | 12/2015 |
| TW | 201514455 | A | 4/2015 |
| WO | WO-2009046223 | A2 | 4/2009 |
| WO | WO-2009144953 | A1 | 12/2009 |
| WO | WO-2012059385 | A1 | 5/2012 |
| WO | WO-2014013070 | A1 | 1/2014 |
| WO | WO-2014122287 | A1 | 8/2014 |
| WO | WO-2014177455 | A1 | 11/2014 |
| WO | WO-2014194099 | A1 | 12/2014 |
| WO | WO-2015007889 | A2 | 1/2015 |

OTHER PUBLICATIONS

"WD1-HOA Text of MPEG-H 3D Audio," MPEG Meeting; Jan. 2014; San Jose; (Motion Picture Expert Group or ISO/IEC JTC1/SC29/WG11), No. N14264, XP030021001, 84 pp.

Boehm, et al., "Scalable Decoding Mode for MPEG-H 3D Audio HOA," MPEG Meeting; Mar. 2014; Valencia; (Motion Picture Expert Group or ISO/IEC JTC1/SC29/WG11), No. M33195, XP030061647, 12 pp.

Boehm, et al., "Detailed Technical Description of 3D Audio Phase 2 Reference Model 0 for HOA technologies", MPEG Meeting; Strasbourg; (Motion Picture Expert Group or ISO/IEC JTC1/SC29/WG11), Oct. 2014, No. M35857, XP030063429, 130 pp.

Boehm, et al., "HOA Decoder—changes and proposed modification," Technicolor, MPEG Meeting; Mar. 2014; Valencia; (Motion Picture Expert Group or ISO/IEC JTC1/SC29/WG11),, No. M33196, XP030061648, 16 pp.

Bosi et al, "ISO/IEC MPEG-2 Advanced Audio Coding", 1996, In 1 01st AES Convention, Los Angeles, Nov. 1996, pp. 1-43.

Conlin, "Interpolation of Data Points on a Sphere: Spherical Harmonics as Basis Functions," Feb. 28, 2012, 6 pp.

Daniel et al., "Multichannel Audio Coding Based on Minimum Audible Angles", Proceedings of 40th International Conference: Spatial Audio: Sense the Sound of Space, Oct. 8, 2010, Jan. 1, 2010, XP055009518, 10 pp.

Daniel, et al., "Spatial Auditory Blurring and Applications to Multichannel Audio Coding", Jun. 23, 2011, XP055104301, Retrieved from the Internet: URL:http://tel.archives-ouvertes.fr/tel-00623670/en/Chapter 5. "Multichannel audio coding based on spatial blurring", 167 pp.

Daniel et al., "Ambisonics Encoding of Other Audio Formats for Multiple Listening Conditions," Audio Engineering Society Convention 105, Sep. 1998, Paper No. 4795 29 pp.

DVB Organization: "ISO-IEC_23008-3_(E)_(DIS of 3DA).docx", DVB, Digital Video Broadcasting, C/0 EBU-17A Ancienne Route-CH-1218 Grand Saconnex, Geneva-Switzerland, Aug. 8, 2014; XP017845569.

Hellerud, et al., "Lossless Compression of Spherical Microphone Array Recordings," AES Convention 126, May 2009, AES, 60 East 42nd Street, Room 2520 New York 10165-2520, USA, May 1, 2009 (May 1, 2009), XP040508950, Section 9 pp.

Gauthier et al., "Beamforming Regularization, Scaling Matrices and Inverse Problems for Sound Field Extrapolation and Characterization: Part I Theory,"Oct. 20-23, 2011, in Audio Engineering Society 131st Convention, 32 pp.

Gauthier et al., "Derivation of Ambisonics Signals and Plane Wave Description of Measured Sound Field Using Irregular Microphone Arrays and Inverse Problem Theory,"Jun. 2-3, 2011, In Ambisonics Symposium 2011, 17 pp.

Geiser, et al., "Steganographic Packet Loss Concealment for Wireless VoIP", ITG Conference on Voice Communication (SprachKommunikation), Oct. 8, 2008, 4 pp.

Gerzon, "Ambisonics in Multichannel Broadcasting and Video", Journal of the Audio Engineering Society, Nov. 1985, vol. 33(11), pp. 859-871.

Hagai, et al., "Acoustic centering of sources measured by surrounding spherical microphone arrays", Oct. 2011, In The Journal of the Acoustical Society of America, vol. 130, No. 4, pp. 2003-2015.

Hellerud, et al., "Encoding higher order ambisonics with AAC," Audio Engineering Society—124th Audio Engineering Society Convention 2008, XP040508582, May 17-20, 2008, 8 pp.

Hellerud, et al., "Spatial redundancy in Higher Order Ambisonics and its use for lowdelay lossless compression", Acoustics, Speech and Signal Processing, 2009, ICASSP 2009, IEEE International Conference on, IEEE, Piscataway, NJ, USA, Apr. 2009, XP031459218, pp. 269-272.

Herre, et al., "MPEG-H 3D Audio—The New Standard for Coding of Immersive Spatial Audio," IEEE Journal of Selected Topics in Signal Processing, vol. 9, No. 5, Aug. 2015, 10 pp.

Huang, et al., "Interpolation of head-related transfer functions using spherical Fourier expansion", Journal of Electronics (China), Jul. 2009, vol. 26, Issue 4, pp. 571-576.

Information technology—High efficiency coding and media delivery in heterogeneous environments—Part 3: 3D Audio, ISO/IEC JTC 1/SC 29, Jul. 25, 2014, 433 pp.

"Information technology—High efficiency coding and media delivery in heterogeneous environments—Part 3: 3D Audio," ISO/IEC JTC 1/SC 29N, Apr. 4, 2014, 337 pp.

(56) References Cited

OTHER PUBLICATIONS

"Information technology—High efficiency coding and media delivery in heterogeneous environments—Part 3: 3D Audio," ISO/IEC JTC 1/SC 29N, Jul. 25, 2005, 311 pp.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
International Search Report and Written Opinion from International Application No. PCT/US2015/013818, dated May 20, 2015, 10 pp.
ISO/IEC/JTC: "ISO/IEC JTC 1/SC 29 N ISO/IEC CD 23008-3 Information technology—High efficiency coding and media delivery in heterogeneous environments—Part 3: 3D audio," Apr. 4, 2014 (Apr. 4, 2014), XP055206371, Retrieved from the Internet: http://www.iso.org/iso/iso_catalogue/catalogue_tc/catalogue_tc_browse.htm?commid=45316 [retrieved on Aug. 5, 2015].
Johnston et al, "AT&T perceptual Audio Coding (PAC)," 1996, In Collected Papers on Digital Audio Bit-Rate Reduction pp. 73-82, Feb. 13, 1996.
Lincoln: "An experimental high fidelity perceptual audio coder", 1998, In Project in MUS420 Win97, Mar. 1998, pp. 1-19.
Malham, "Higher order ambisonic systems for the spatialization of sound", in Proceedings of the International Computer Music Conference, 1999, Beijing, China, pp. 484-487. (Applicant points out that, in accordance with MPEP 609.04(a), the 1999 year of publication is sufficiently earlier than the effective U.S. filling date and any foreign priority date of Jan 9, 2014 so that the particular month of publication is not in issue.).
Masgrau, et al., "Predictive SVD-Transform Coding of Speech with Adaptive Vector Quantization," Apr. 1991, IEEE, pp. 3681-3684.
Mathews et al., "Multiplication-Free Vector Quantization Using L1 Distortion Measure and its Variants", Multidimensional Signal Processing, Audio and Electroacoustics, May 23-26, 1989, [International Conference on Acoustics, Speech & Signal Processing, ICASSP], IEEE, XP000089211 5 pp.
Menzies, "Nearfield synthesis of complex sources with high-order ambisonics, and binaural rendering," Proceedings of the 13th International Conference on Auditory Display, Montr'eal, Canada, Jun. 26-29, 2007, 8 pp.
Moreau, et al., "3D Sound Field Recording with Higher Order Ambisonics—Objective Measurements and Validation of Spherical Microphone", May 2006, Audio Engineering Society Convention Paper 6857, 24 pp.
Nelson et al., "Spherical Harmonics, Singular-Value Decomposition and the Head-Related Transfer Function," Journal of Sound, Aug. 29, 2000, ISVR University of Southampton, 31 pp.
Nishimura R., "Audio Watermarking Using Spatial Masking and Ambisonics", IEEE Transactions on Audio, Speech and Language Processing, IEEE Service Center, New York, NY, USA, val. 20, No. 9, Nov. 1, 2012 (Nov. 1, 2012), pp. 2461-2469, XP011471463, ISSN: 1558-7916, DOI: 10.1109/TASL.2012.2203810.
Painter, et al., Perceptual Coding of Digital Audio, Proceedings of the IEEE, vol. 88, No. 4, Apr. 2000, pp. 451-513.
Poletti, "Three-Dimensional Surround Sound Systems Based on Spherical Harmonics," The Journal of the Audio Engineering Society, Nov. 2005, vol. 53 (11), pp. 1004-1025.
Poletti, "Unified Description of Ambisonics Using Real and Complex Spherical Harmonics," Ambisonics Symposium Jun. 25-27, 2009, 10 pp.
Pulkki V., "Spatial Sound Reproduction with Directional Audio Coding," Journal of the Audio Engineering Society, Jun. 2007, vol. 55 (6), pp. 503-516.
Rafaely, "Spatial alignment of acoustic sources based on spherical harmonics radiation analysis," 4th International Symposium on Communications, Control and Signal Processing (ISCCSP), Mar. 3-5, 2010.
Davis, et al., "A Simple and Efficient Method for Real-Time Computation and Transformation of Spherical Harmonic-Based Sound Fields", Oct. 26-29, 2012; Proceedings of the AES 133rd Convention, 2012, 10 pp.
Rockway, et al., "Interpolating Spherical Harmonics for Computing Antenna Patterns," Systems Center Pacific, Technical Report, 1999, Jul. 2011, 40 pp.
Ruffini, et al., "Spherical Harmonics Interpolation, Computation of Laplacians and Gauge Theory," Starlab Research Knowledge, Oct. 25, 2001, 16 pp.
Ryouichi, "Audio Information Hiding Based on Spatial Masking", Sixth International Conference on Intelligent Information Hidinga and Multimedia Signal Processing (IIH-MSP), IEEE, Oct. 15, 2010, XP031801765 4 pp.
Sayood, et al., "Application to Image Compression—JPEG,"Introduction to Data Compression, Third Edition, Elsevier, Dec. 15, 2005, 11 pp.
Sen, et al., "Differences and Similarities in Formats for Scene Based Audio,"ISO/IEC JTC1/SC29/WG11 MPEG2012/M26704, Oct. 2012, Shanghai, China, 7 pp.
Sen et al., "RM1-HOA Working Draft Text", MPEG MEETING; Jan. 2014, San Jose; (Motion Picture Expert Group or ISO/IEC JTC1/SC29/WG11), No. M31827, XP030060280, 83 pp.
Solvang A et al., "Quantization of Higher Order Ambisonics Wave Fields," Audio Engineering Society, In the 124th AES Conv, May 17-20, 2008, 9 pp.
Stohl, et al., "An Intercomparison of Results from Three Trajectory Models," Meteorological Applications, Jun. 2001, 9 pp.
Wabnitz, et al., "A frequency-domain algorithm to upscale ambisonic sound scenes", 2012 IEEE International Conference on Acoustics, Speech and Signal Processing (ICASSP 2012): Kyoto, Japan, IEEE, Piscataway, NJ, Mar. 2012, XP032227141, pp. 385-388.
Wabnitz et al., "Time domain reconstruction of spatial sound fields using compressed sensing", Acoustics, Speech and Signal Processing (ICASSP), 2011 IEEE International Conference on, IEEE, May 2011, XP032000755, pp. 465-468.
Wabnitz, et al., "Upscaling Ambisonic sound scenes using compressed sensing techniques", Applications of Signal Processing to Audio and Acoustics (WASPAA) , 2011 IEEE Workshop on, IEEE, Oct. 2011; XP032011510, 4 pp.
Zotter, et al., "Comparison of energy-preserving and all-round Ambisonic decorders,"Mar. 2013, 4 pp.
Information technology—MPEG audio technologies—Part 3: Unified speech and audio coding, ISO/IEC JTC 1/SC 26/ WG 11, Sep. 20, 2011, 291 pp.
Paila, et al., "FLUTE—File Delivery over Unidirectional Transport,"Internet Engineering Task Force, RFC 6726, Nov. 2012, 46 pp.
ISO/IEC 23009-1: "Information technology—Dynamic adaptive streaming over HTTP (DASH)—Part 1: Media presentation description and segment formats," Technologies de l'information—Diffusion en flux adaptatif dynamique sur HTTP (DASH)—Part 1: Description of the presentation and delivery of media formats, ISO/IEC 23009-1 International Standard, First Edition, Apr. 2012; 132 pp.
Neuendorf, et al., "Contribution to MPEG-H 3D Audio Version 1,"ISO/IEC JTC1/SC29/WG11 MPEG2013/M31360, Oct. 2013, 34 pp.
Wuebbolt, et al., "Thoughts on MPEG-H 3D Audio Integration," Research & Innovation Hannover, Technicolor, Feb. 3, 2014, 9 pp.
International Preliminary Report on Patentability from International Application No. PCT/US2015/013818, dated Aug. 11, 2016, 8 pp.
U.S. Appl. No. 15/247,244, filed by Nils Gunther Peters, on Aug. 25, 2016.
U.S. Appl. No. 15/290,181, filed by Nils Gunther Peters, on Oct. 11, 2016.
U.S. Appl. No. 15/290,214, filed by Nils Gunther Peters, on Oct. 11, 2016.
Zotter, et al., "Energy-Preserving Ambisonic Decoding," ACTA Acustica United with Acustica, vol. 98, accepted for publication Jan. 2012, pp. 37-47.
Noisternig et al., "A 3D Real Time Rendering Engine for Binaural Sound Reproduction," Proceedings of the 2003 International Conference on Auditory Display, Jul. 6-9, 2003, pp. 107-110.

* cited by examiner

REUSE OF SYNTAX ELEMENT INDICATING VECTOR QUANTIZATION CODEBOOK USED IN COMPRESSING VECTORS

This application is a continuation of U.S. patent application Ser. No. 14/609,190, filed Jan. 29, 2015, which claims the benefit of the following U.S. Provisional Applications:

U.S. Provisional Application No. 61/933,706, filed Jan. 30, 2014, entitled "COMPRESSION OF DECOMPOSED REPRESENTATIONS OF A SOUND FIELD,"

U.S. Provisional Application No. 61/933,714, filed Jan. 30, 2014, entitled "COMPRESSION OF DECOMPOSED REPRESENTATIONS OF A SOUND FIELD,"

U.S. Provisional Application No. 61/933,731, filed Jan. 30, 2014, entitled "INDICATING FRAME PARAMETER REUSABILITY FOR DECODING SPATIAL VECTORS,"

U.S. Provisional Application No. 61/949,591, filed Mar. 7, 2014, entitled "IMMEDIATE PLAY-OUT FRAME FOR SPHERICAL HARMONIC COEFFICIENTS,"

U.S. Provisional Application No. 61/949,583, filed Mar. 7, 2014, entitled "FADE-IN/FADE-OUT OF DECOMPOSED REPRESENTATIONS OF A SOUND FIELD,"

U.S. Provisional Application No. 61/994,794, filed May 16, 2014, entitled "CODING V-VECTORS OF A DECOMPOSED HIGHER ORDER AMBISONICS (HOA) AUDIO SIGNAL,"

U.S. Provisional Application No. 62/004,147, filed May 28, 2014, entitled "INDICATING FRAME PARAMETER REUSABILITY FOR DECODING SPATIAL VECTORS,"

U.S. Provisional Application No. 62/004,067, filed May 28, 2014, entitled "IMMEDIATE PLAY-OUT FRAME FOR SPHERICAL HARMONIC COEFFICIENTS AND FADE-IN/FADE-OUT OF DECOMPOSED REPRESENTATIONS OF A SOUND FIELD,"

U.S. Provisional Application No. 62/004,128, filed May 28, 2014, entitled "CODING V-VECTORS OF A DECOMPOSED HIGHER ORDER AMBISONICS (HOA) AUDIO SIGNAL,"

U.S. Provisional Application No. 62/019,663, filed Jul. 1, 2014, entitled "CODING V-VECTORS OF A DECOMPOSED HIGHER ORDER AMBISONICS (HOA) AUDIO SIGNAL,"

U.S. Provisional Application No. 62/027,702, filed Jul. 22, 2014, entitled "CODING V-VECTORS OF A DECOMPOSED HIGHER ORDER AMBISONICS (HOA) AUDIO SIGNAL,"

U.S. Provisional Application No. 62/028,282, filed Jul. 23, 2014, entitled "CODING V-VECTORS OF A DECOMPOSED HIGHER ORDER AMBISONICS (HOA) AUDIO SIGNAL,"

U.S. Provisional Application No. 62/029,173, filed Jul. 25, 2014, entitled "IMMEDIATE PLAY-OUT FRAME FOR SPHERICAL HARMONIC COEFFICIENTS AND FADE-IN/FADE-OUT OF DECOMPOSED REPRESENTATIONS OF A SOUND FIELD,"

U.S. Provisional Application No. 62/032,440, filed Aug. 1, 2014, entitled "CODING V-VECTORS OF A DECOMPOSED HIGHER ORDER AMBISONICS (HOA) AUDIO SIGNAL,"

U.S. Provisional Application No. 62/056,248, filed Sep. 26, 2014, entitled "SWITCHED V-VECTOR QUANTIZATION OF A HIGHER ORDER AMBISONICS (HOA) AUDIO SIGNAL," and U.S. Provisional Application No. 62/056,286, filed Sep. 26, 2014, entitled "PREDICTIVE VECTOR QUANTIZATION OF A DECOMPOSED HIGHER ORDER AMBISONICS (HOA) AUDIO SIGNAL," and U.S. Provisional Application No. 62/102,243, filed Jan. 12, 2015, entitled "TRANSITIONING OF AMBIENT HIGHER-ORDER AMBISONIC COEFFICIENTS,"

each of foregoing listed U.S. provisional and non-provisional patent applications is incorporated by reference as if set forth in their respective entirety herein.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for coding of higher-order ambisonics audio data. Higher-order ambisonics audio data may comprise at least one spherical harmonic coefficient corresponding to a spherical harmonic basis function having an order greater than one.

In one aspect, a method of efficient bit use comprises obtaining a bitstream comprising a vector representative of an orthogonal spatial axis in a spherical harmonics domain. The bitstream further comprises an indicator for whether to reuse, from a previous frame, at least one syntax element indicative of information used when compressing the vector.

In another aspect, a device configured to perform efficient bit use comprises one or more processors configured to obtain a bitstream comprising a vector representative of an orthogonal spatial axis in a spherical harmonics domain. The bitstream further comprises an indicator for whether to reuse, from a previous frame, at least one syntax element indicative of information used when compressing the vector. The device also comprises a memory configured to store the bitstream.

In another aspect, a device configured to perform efficient bit use comprises means for obtaining a bitstream comprising a vector representative of an orthogonal spatial axis in a spherical harmonics domain. The bitstream further comprises an indicator for whether to reuse, from a previous frame, at least one syntax element indicative of information used when compressing the vector. The device also comprises means for storing the indicator.

In another aspect, a non-transitory computer-readable storage medium has stored thereon instructions that when executed cause one or more processors to obtain a bitstream comprising a vector representative of an orthogonal spatial axis in a spherical harmonics domain, wherein the bitstream further comprises an indicator for whether to reuse, from a previous frame, at least one syntax element indicative of information used when compressing the vector.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
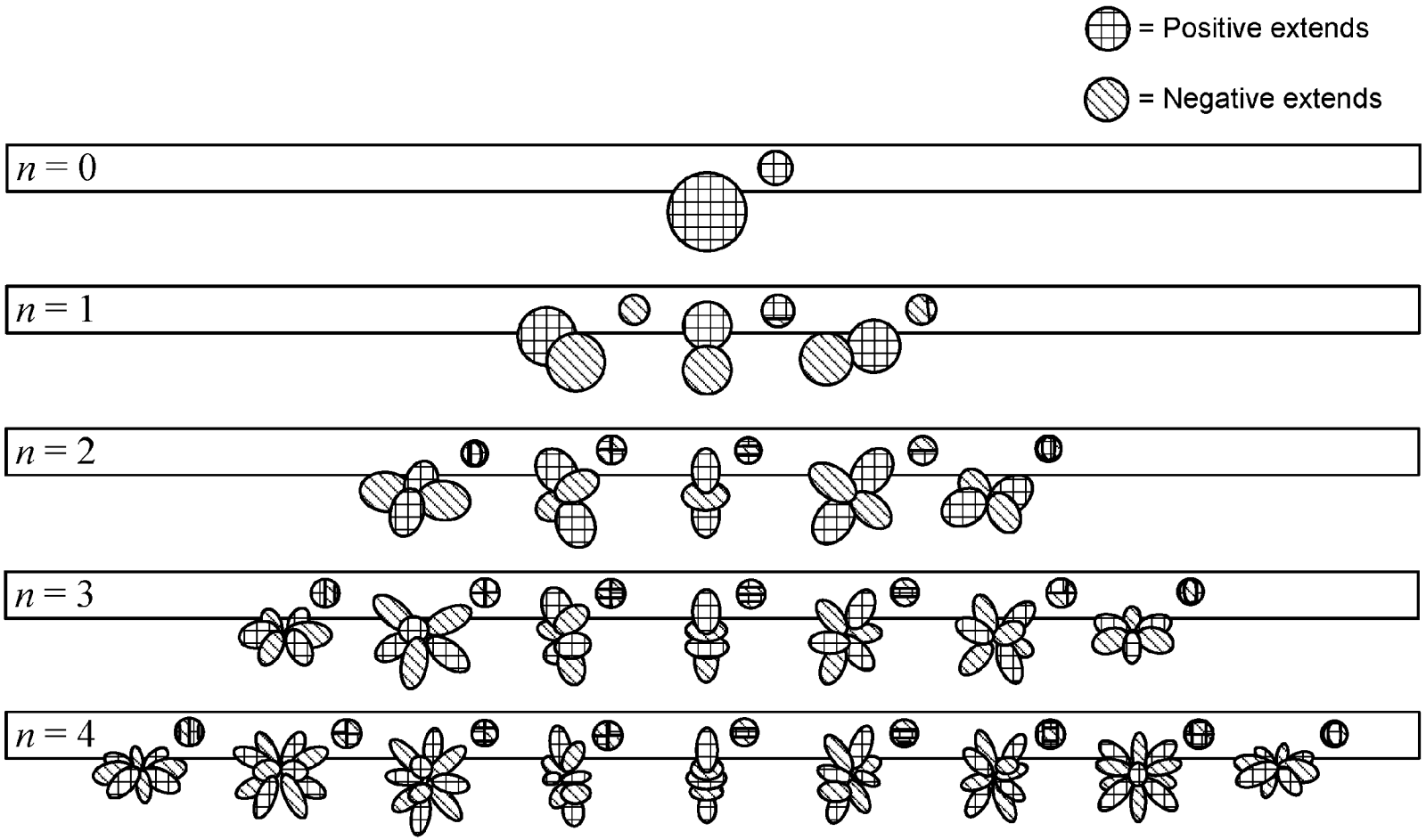
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \phi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \phi_r\}$ is a point of reference (or observation point), $j_n(\cdot)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 Nov., pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s, \phi_s),$$

where i is $\sqrt{-1}$, $h_n^{(2)}(\cdot)$ is the spherical Hankel function (of the second kind) of order n, and $\{r_s, \theta_s, \phi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \phi_r\}$. The remaining figures are described below in the context of object-based and SHC-based audio coding.

Figure 2:
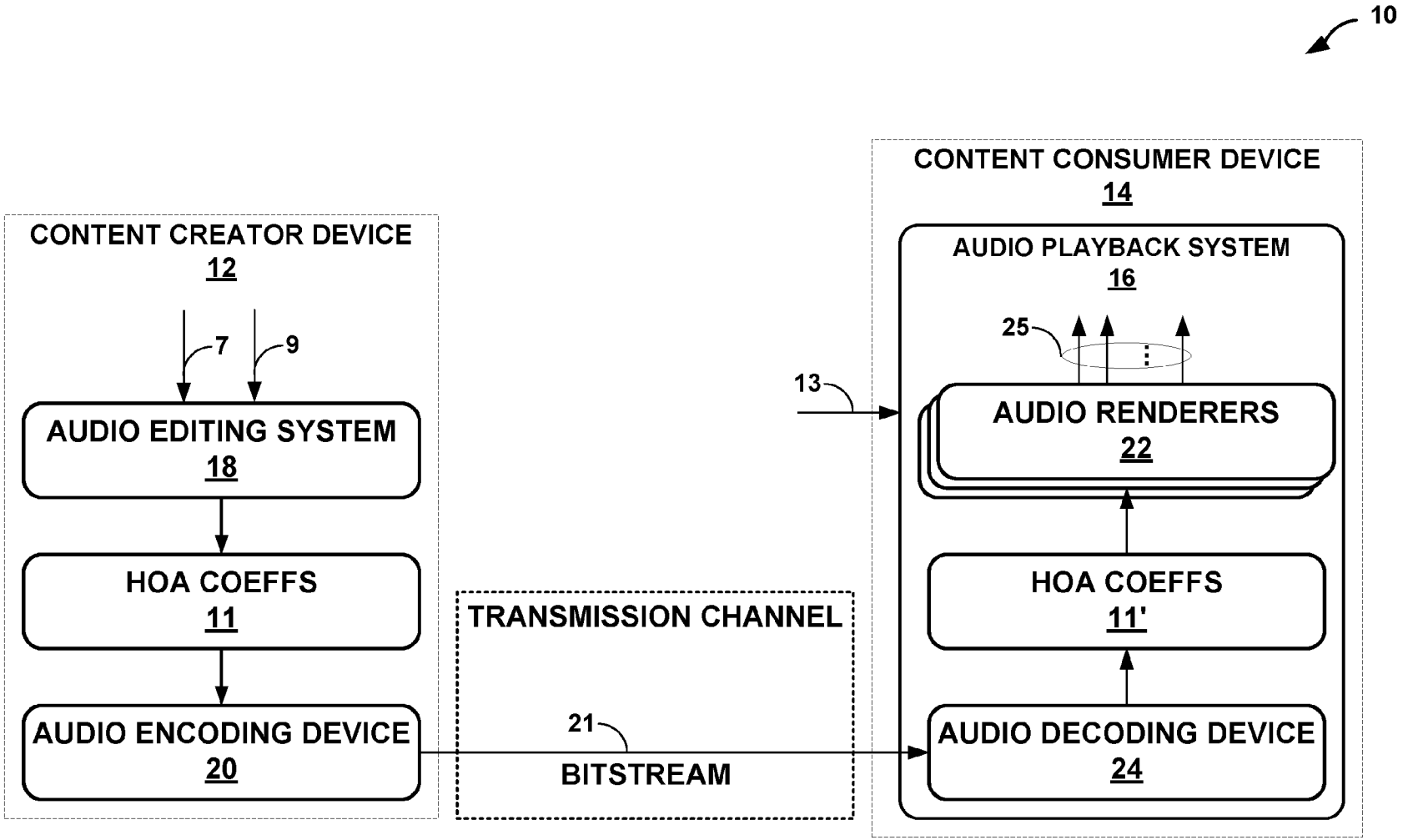
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of a content consumers, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

Although described in more detail below, the audio encoding device 20 may be configured to encode the HOA coefficients 11 based on a vector-based synthesis or a directional-based synthesis. To determine whether to perform the vector-based decomposition methodology or a directional-based decomposition methodology, the audio encoding device 20 may determine, based at least in part on the HOA coefficients 11, whether the HOA coefficients 11 were generated via a natural recording of a soundfield (e.g., live recording 7) or produced artificially (i.e., synthetically) from, as one example, audio objects 9, such as a PCM object. When the HOA coefficients 11 were generated from the audio objects 9, the audio encoding device 20 may encode the HOA coefficients 11 using the directional-based decomposition methodology. When the HOA coefficients 11 were captured live using, for example, an eigenmike, the audio encoding device 20 may encode the HOA coefficients 11 based on the vector-based decomposition methodology. The above distinction represents one example of where vector-based or directional-based decomposition methodology may be deployed. There may be other cases where either or both may be useful for natural recordings, artificially generated content or a mixture of the two (hybrid content).

Furthermore, it is also possible to use both methodologies simultaneously for coding a single time-frame of HOA coefficients.

Assuming for purposes of illustration that the audio encoding device 20 determines that the HOA coefficients 11 were captured live or otherwise represent live recordings, such as the live recording 7, the audio encoding device 20 may be configured to encode the HOA coefficients 11 using a vector-based decomposition methodology involving application of a linear invertible transform (LIT). One example of the linear invertible transform is referred to as a "singular value decomposition" (or "SVD"). In this example, the audio encoding device 20 may apply SVD to the HOA coefficients 11 to determine a decomposed version of the HOA coefficients 11. The audio encoding device 20 may then analyze the decomposed version of the HOA coefficients 11 to identify various parameters, which may facilitate reordering of the decomposed version of the HOA coefficients 11. The audio encoding device 20 may then reorder the decomposed version of the HOA coefficients 11 based on the identified parameters, where such reordering, as described in further detail below, may improve coding efficiency given that the transformation may reorder the HOA coefficients across frames of the HOA coefficients (where a frame may include M samples of the HOA coefficients 11 and M is, in some examples, set to 1024). After reordering the decomposed version of the HOA coefficients 11, the audio encoding device 20 may select the decomposed version of the HOA coefficients 11 representative of foreground (or, in other words, distinct, predominant or salient) components of the soundfield. The audio encoding device 20 may specify the decomposed version of the HOA coefficients 11 representative of the foreground components as an audio object and associated directional information.

The audio encoding device 20 may also perform a soundfield analysis with respect to the HOA coefficients 11 in order, at least in part, to identify the HOA coefficients 11 representative of one or more background (or, in other words, ambient) components of the soundfield. The audio encoding device 20 may perform energy compensation with respect to the background components given that, in some examples, the background components may only include a subset of any given sample of the HOA coefficients 11 (e.g., such as the HOA coefficients 11 corresponding to zero and first order spherical basis functions and not the HOA coefficients 11 corresponding to second or higher-order spherical basis functions). When order-reduction is performed, in other words, the audio encoding device 20 may augment (e.g., add/subtract energy to/from) the remaining background HOA coefficients of the HOA coefficients 11 to compensate for the change in overall energy that results from performing the order reduction.

The audio encoding device 20 may next perform a form of psychoacoustic encoding (such as MPEG surround, MPEG-AAC, MPEG-USAC or other known forms of psychoacoustic encoding) with respect to each of the HOA coefficients 11 representative of background components and each of the foreground audio objects. The audio encoding device 20 may perform a form of interpolation with respect to the foreground directional information and then perform an order reduction with respect to the interpolated foreground directional information to generate order reduced foreground directional information. The audio encoding device 20 may further perform, in some examples, a quantization with respect to the order reduced foreground directional information, outputting coded foreground directional information. In some instances, the quantization may comprise a scalar/entropy quantization. The audio encoding device 20 may then form the bitstream 21 to include the encoded background components, the encoded foreground audio objects, and the quantized directional information. The audio encoding device 20 may then transmit or otherwise output the bitstream 21 to the content consumer device 14.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (loudspeaker geometry wise) to that specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22.

Figure 3:
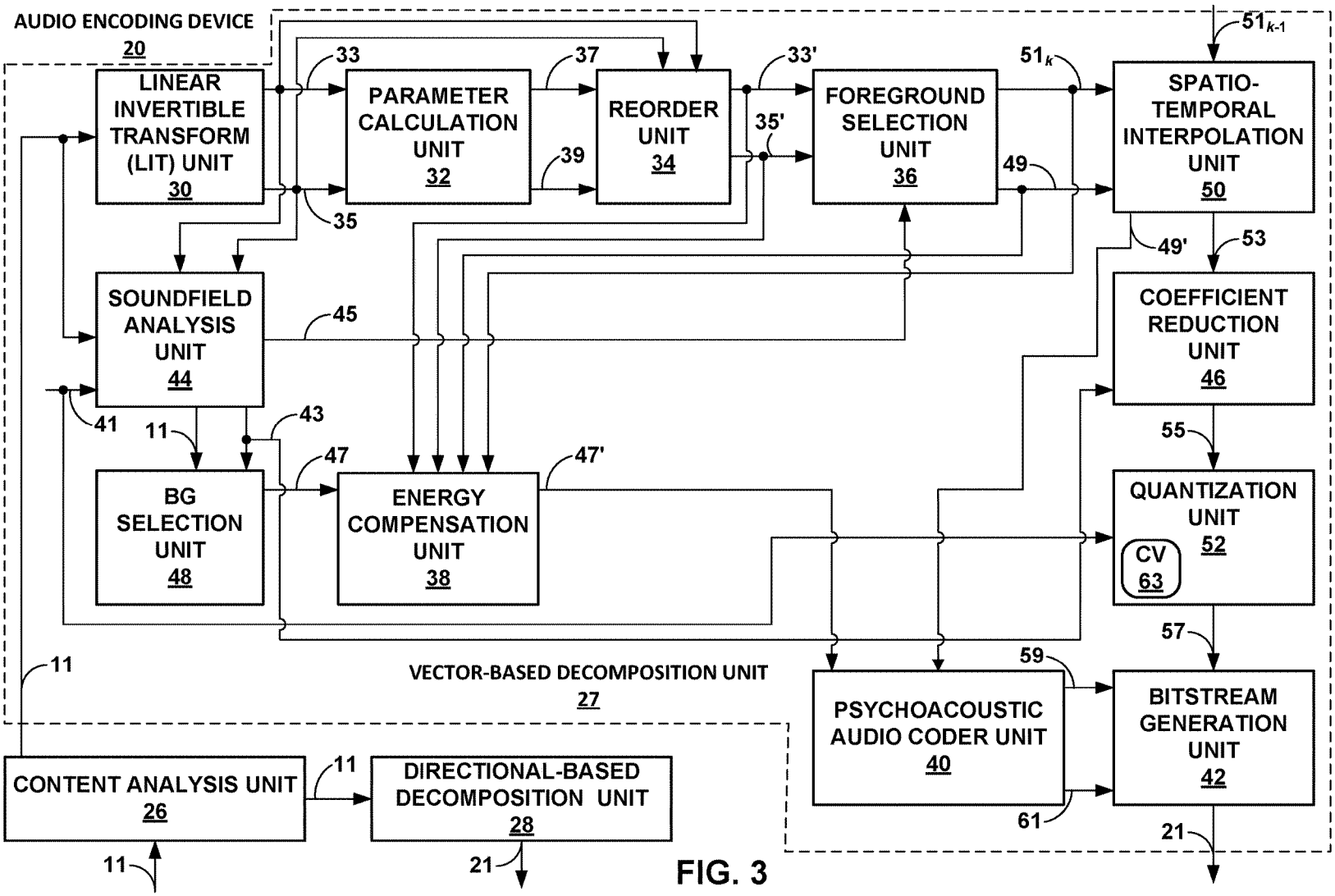
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May, 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

That is, the LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA." PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. The principal components may be described as having a small degree of statistical correlation to one another. In any event, the number of so-called principal components is less than or equal to the number of original variables. In some examples, the transformation is defined in such a way that the first principal component has the largest possible variance (or, in other words, accounts for as much of the variability in the data as possible), and each succeeding component in turn has the highest variance possible under the constraint that the successive component be orthogonal to (which may be restated as uncorrelated with) the preceding components. PCA may perform a form of order-reduction, which in terms of the HOA coefficients 11 may result in the compression of the HOA coefficients 11. Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

While described in this disclosure as being applied to multi-channel audio data comprising HOA coefficients 11, the techniques may be applied to any form of multi-channel audio data. In this way, the audio encoding device 20 may perform a singular value decomposition with respect to multi-channel audio data representative of at least a portion of soundfield to generate a U matrix representative of left-singular vectors of the multi-channel audio data, an S matrix representative of singular values of the multi-channel audio data and a V matrix representative of right-singular vectors of the multi-channel audio data, and representing the multi-channel audio data as a function of at least a portion of one or more of the U matrix, the S matrix and the V matrix.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In any event, the LIT unit 30 may perform a block-wise form of SVD with respect to each block (which may refer to a frame) of higher-order ambisonics (HOA) audio data (where the ambisonics audio data includes blocks or samples of the HOA coefficients 11 or any other form of multi-channel audio data). As noted above, a variable M may be used to denote the length of an audio frame in samples. For example, when an audio frame includes 1024 audio samples, M equals 1024. Although described with respect to the typical value for M, the techniques of the disclosure should not be limited to the typical value for M. The LIT unit 30 may therefore perform a block-wise SVD with respect to a block the HOA coefficients 11 having M-by-$(N+1)^2$ HOA coefficients, where N, again, denotes the order of the HOA audio data. The LIT unit 30 may generate, through performing the SVD, a V matrix, an S matrix, and a U matrix, where each of matrixes may represent the respective V, S and U matrixes described above. In this way, the linear invertible transform unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) width may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape and direction of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with true energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. The power spectral density matrix may be denoted as PSD and obtained through matrix multiplication of the transpose of the hoaFrame to the hoaFrame, as outlined in the pseudo-code that follows below. The hoaFrame notation refers to a frame of the HOA coefficients 11.

The LIT unit 30 may, after applying the SVD (svd) to the PSD, may obtain an $S[k]^2$ matrix (S_squared) and a V[k] matrix. The $S[k]^2$ matrix may denote a squared S[k] matrix, whereupon the LIT unit 30 may apply a square root operation to the $S[k]^2$ matrix to obtain the S[k] matrix. The LIT unit 30 may, in some instances, perform quantization with respect to the V[k] matrix to obtain a quantized V[k] matrix (which may be denoted as V[k]' matrix). The LIT unit 30 may obtain the U[k] matrix by first multiplying the S[k] matrix by the quantized V[k]' matrix to obtain an SV[k]' matrix. The LIT unit 30 may next obtain the pseudo-inverse (pinv) of the SV[k]' matrix and then multiply the HOA coefficients 11 by the pseudo-inverse of the SV[k]' matrix to obtain the U[k] matrix. The foregoing may be represented by the following pseud-code:

```
PSD = hoaFrame'*hoaFrame;
[V, S_squared] = svd(PSD,'econ');
```

-continued

```
S = sqrt(S_squared);
U = hoaFrame * pinv(S*V');
```

By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients. That is, the above described PSD-type SVD may be potentially less computational demanding because the SVD is done on an F*F matrix (with F the number of HOA coefficients),compared to an M*F matrix with M is the frame length, i.e., 1024 or more samples. The complexity of an SVD may now, through application to the PSD rather than the HOA coefficients 11, be around $O(L^3)$ compared to $O(M*L^2)$ when applied to the HOA coefficients 11 (where O(*) denotes the big-O notation of computation complexity common to the computer-science arts).

In this respect, the LIT unit 30 may perform a decomposition with respect to or otherwise decompose the higher-order ambisonic audio data 11 to obtain a vector (e.g., the V-vector above) representative of orthogonal spatial axis in a spherical harmonics domain. The decomposition may include SVD, EVD or any other form of decomposition.

The parameter calculation unit 32 represents a unit configured to calculate various parameters, such as a correlation parameter (R), directional properties parameters (θ, ϕ, r), and an energy property (e). Each of the parameters for the current frame may be denoted as R[k], θ[k], ϕ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], ϕ[k−1], r[k−1] and e[k−1], based on the previous frame of US[k−1] vector and V[k−1] vectors. The parameter calculation unit 32 may output the current parameters 37 and the previous parameters 39 to reorder unit 34.

The SVD decomposition does not guarantee that the audio signal/object represented by the p-th vector in US[k−1] vectors 33, which may be denoted as the US[k−1][p] vector (or, alternatively, as $X_{PS}^{(p)}(k-1)$), will be the same audio signal/object (progressed in time) represented by the p-th vector in the US[k] vectors 33, which may also be denoted as US[k][p] vectors 33 (or, alternatively as $X_{PS}^{(p)}(k)$). The parameters calculated by the parameter calculation unit 32 may be used by the reorder unit 34 to re-order the audio objects to represent their natural evaluation or continuity over time.

That is, the reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield ($nBGa=(MinAmbHOAorder+1)^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by $(MinAmbHOAorder+1)^2$+the number of times the index 10 (in the above example) appears as a channel type in the bitstream for that frame.

In any event, the soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx."

To illustrate, assume that the minAmbHOAorder is set to 1 and an additional ambient HOA coefficient with an index of six is sent via the bitstream 21 as one example. In this example, the minAmbHOAorder of 1 indicates that ambient HOA coefficients have an index of 1, 2, 3 and 4. The audio encoding device 20 may select the ambient HOA coefficients because the ambient HOA coefficients have an index less than or equal to $(\text{minAmbHOAorder}+1)^2$ or 4 in this example. The audio encoding device 20 may specify the ambient HOA coefficients associated with the indices of 1, 2, 3 and 4 in the bitstream 21. The audio encoding device 20 may also specify the additional ambient HOA coefficient with an index of 6 in the bitstream as an additionalAmbientHOAchannel with a ChannelType of 10. The audio encoding device 20 may specify the index using the CodedAmbCoeffIdx syntax element. As a practical matter, the CodedAmbCoeffIdx element may specify all of the indices from 1-25. However, because the minAmbHOAorder is set to one, the audio encoding device 20 may not specify any of the first four indices (as the first four indices are known to be specified in the bitstream 21 via the minAmbHOAorder syntax element). In any event, because the audio encoding device 20 specifies the five ambient HOA coefficients via the minAmbHOAorder (for the first four) and the CodedAmbCoeffIdx (for the additional ambient HOA coefficient), the audio encoding device 20 may not specify the corresponding V-vector elements associated with the ambient HOA coefficients having an index of 1, 2, 3, 4 and 6. As a result, the audio encoding device 20 may specify the V-vector with elements [5, 7:25].

In a second aspect, all of the foreground/predominant signals are vector-based signals. In this second aspect, the total number of foreground/predominant signals may be given by $\text{nFG}=\text{numHOATransportChannels}-[(\text{MinAmbHOAorder}+1)^2+\text{each of the additionalAmbientHOAchannel}]$.

The soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+\text{nBGa}]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $\text{US}[k]_{1,\ldots nFG}$ 49, $\text{FG}_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times\text{nFG}$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder.

In operation, the spatio-temporal interpolation unit 50 may interpolate one or more sub-frames of a first audio frame from a first decomposition, e.g., foreground V[k] vectors $\mathbf{51}_k$, of a portion of a first plurality of the HOA coefficients 11 included in the first frame and a second decomposition, e.g., foreground V[k] vectors $\mathbf{51}_{k-1}$, of a portion of a second plurality of the HOA coefficients 11 included in a second frame to generate decomposed interpolated spherical harmonic coefficients for the one or more sub-frames.

In some examples, the first decomposition comprises the first foreground V[k] vectors $\mathbf{51}_k$ representative of right-singular vectors of the portion of the HOA coefficients 11. Likewise, in some examples, the second decomposition comprises the second foreground V[k] vectors $\mathbf{51}_k$ representative of right-singular vectors of the portion of the HOA coefficients 11.

In other words, spherical harmonics-based 3D audio may be a parametric representation of the 3D pressure field in terms of orthogonal basis functions on a sphere. The higher the order N of the representation, the potentially higher the spatial resolution, and often the larger the number of spherical harmonics (SH) coefficients (for a total of $(N+1)^2$ coefficients). For many applications, a bandwidth compression of the coefficients may be required for being able to transmit and store the coefficients efficiently. The techniques directed in this disclosure may provide a frame-based, dimensionality reduction process using Singular Value Decomposition (SVD). The SVD analysis may decompose each frame of coefficients into three matrices U, S and V. In some examples, the techniques may handle some of the vectors in US[k] matrix as foreground components of the underlying soundfield. However, when handled in this manner, the vectors (in US[k] matrix) are discontinuous from frame to frame—even though they represent the same distinct audio component. The discontinuities may lead to significant artifacts when the components are fed through transform-audio-coders.

In some respects, the spatio-temporal interpolation may rely on the observation that the V matrix can be interpreted as orthogonal spatial axes in the Spherical Harmonics domain. The U[k] matrix may represent a projection of the Spherical Harmonics (HOA) data in terms of the basis functions, where the discontinuity can be attributed to orthogonal spatial axis (V[k]) that change every frame—and are therefore discontinuous themselves. This is unlike some other decompositions, such as the Fourier Transform, where the basis functions are, in some examples, constant from frame to frame. In these terms, the SVD may be considered as a matching pursuit algorithm. The spatio-temporal interpolation unit 50 may perform the interpolation to potentially maintain the continuity between the basis functions (V[k]) from frame to frame—by interpolating between them.

As noted above, the interpolation may be performed with respect to samples. The case is generalized in the above description when the sub-frames comprise a single set of samples. In both the case of interpolation over samples and over sub-frames, the interpolation operation may take the form of the following equation:

$$\overline{v(l)}=w(l)v(k)+(1-w(l)v(k-1).$$

In the above equation, the interpolation may be performed with respect to the single V-vector v(k) from the single V-vector v(k−1), which in one aspect could represent V-vectors from adjacent frames k and k−1. In the above equation, l, represents the resolution over which the interpolation is being carried out, where l may indicate a integer sample and l=1, . . . , T (where T is the length of samples over which the interpolation is being carried out and over which the output interpolated vectors, $\overline{v(l)}$ are required and also indicates that the output of the process produces l of the vectors). Alternatively, l could indicate sub-frames consisting of multiple samples. When, for example, a frame is divided into four sub-frames, l may comprise values of 1, 2, 3 and 4, for each one of the sub-frames. The value of l may be signaled as a field termed "CodedSpatialInterpolationTime" through a bitstream—so that the interpolation operation may be replicated in the decoder. The w(l) may comprise values of the interpolation weights. When the interpolation is linear, w(l) may vary linearly and monotonically between 0 and 1, as a function of l. In other instances, w(l) may vary between 0 and 1 in a non-linear but monotonic fashion (such as a quarter cycle of a raised cosine) as a function of l. The function, w(l), may be indexed between a few different possibilities of functions and signaled in the bitstream as a field termed "SpatialInterpolationMethod" such that the identical interpolation operation may be replicated by the decoder. When w(l) has a value close to 0, the output, $\overline{v(l)}$, may be highly weighted or influenced by v(k−1). Whereas when w(l) has a value close to 1, it ensures that the output, $\overline{v(l)}$, is highly weighted or influenced by v(k−1).

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$.

The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. As described above, in some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond NBG but to identify additional HOA channels (which may be denoted by the variable TotalOfAddAmbHOAChan) from the set of $[(N_{BG}+1)^2+1, (N+1)^2]$. The soundfield analysis unit 44 may analyze the HOA coefficients 11 to determine $BG_{TOT}$, which may identify not only the $(N_{BG}+1)^2$ but the TotalOfAddAmbHOAChan, which may collectively be referred to as the background channel information 43. The coefficient reduction unit 46 may then remove the coefficients corresponding to the $(N_{BG}+1)^2$ and the TotalOfAddAmbHOAChan from the remaining foreground V[k] vectors 53 to generate a smaller dimensional V[k] matrix 55 of size $((N+1)^2-(BG_{TOT})\times nFG$, which may also be referred to as the reduced foreground V[k] vectors 55.

In other words, as noted in publication no. WO 2014/194099, the coefficient reduction unit 46 may generate syntax elements for the side channel information 57. For example, the coefficient reduction unit 46 may specify a syntax element in a header of an access unit (which may include one or more frames) denoting which of the plurality of configuration modes was selected. Although described as being specified on a per access unit basis, the coefficient reduction unit 46 may specify the syntax element on a per frame basis or any other periodic basis or non-periodic basis (such as once for the entire bitstream). In any event, the syntax element may comprise two bits indicating which of the three configuration modes were selected for specifying the non-zero set of coefficients of the reduced foreground V[k] vectors 55 to represent the directional aspects of the distinct component. The syntax element may be denoted as "CodedVVecLength." In this manner, the coefficient reduction unit 46 may signal or otherwise specify in the bitstream which of the three configuration modes were used to specify the reduced foreground V[k] vectors 55 in the bitstream 21.

For example, three configuration modes may be presented in the syntax table for VVecData (later referenced in this document). In that example, the configuration modes are as follows: (Mode 0), a complete V-vector length is transmitted in the VVecData field; (Mode 1), the elements of the V-vector associated with the minimum number of coefficients for the Ambient HOA coefficients and all the elements of the V-vector which included additional HOA channels that are not transmitted; and (Mode 2), the elements of the V-vector associated with the minimum number of coefficients for the Ambient HOA coefficients are not transmitted. The syntax table of VVecData illustrates the modes in connection with a switch and case statement. Although described with respect to three configuration modes, the techniques should not be limited to three configuration modes and may include any number of configuration modes, including a single configuration mode or a plurality of modes. Publication no. WO 2014/194099 provides a different example with four modes. The coefficient reduction unit 46 may also specify the flag 63 as another syntax element in the side channel information 57.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. For purposes of example, the reduced foreground V[k] vectors 55 are assumed to include two row vectors having, as a result of the coefficient reduction, less than 25 elements each (which implies a fourth order HOA representation of the soundfield). Although described with respect to two row vectors, any number of vectors may be included in the reduced foreground V[k] vectors 55 up to $(n+1)^2$, where n denotes the order of the HOA representation of the soundfield. Moreover, although described below as performing a scalar and/or entropy quantization, the quantization unit 52 may perform any form of quantization that results in compression of the reduced foreground V[k] vectors 55.

The quantization unit 52 may receive the reduced foreground V[k] vectors 55 and perform a compression scheme to generate coded foreground V[k] vectors 57. The compression scheme may involve any conceivable compression scheme for compressing elements of a vector or data generally, and should not be limited to the example described below in more detail. The quantization unit 52 may perform, as an example, a compression scheme that includes one or more of transforming floating point representations of each element of the reduced foreground V[k] vectors 55 to integer representations of each element of the reduced foreground V[k] vectors 55, uniform quantization of the integer representations of the reduced foreground V[k] vectors 55 and categorization and coding of the quantized integer representations of the remaining foreground V[k] vectors 55.

In some examples, several of the one or more processes of the compression scheme may be dynamically controlled by parameters to achieve or nearly achieve, as one example, a target bitrate 41 for the resulting bitstream 21. Given that each of the reduced foreground V[k] vectors 55 are orthonormal to one another, each of the reduced foreground V[k] vectors 55 may be coded independently. In some examples, as described in more detail below, each element of each reduced foreground V[k] vectors 55 may be coded using the same coding mode (defined by various sub-modes).

As described in publication no. WO 2014/194099, the quantization unit 52 may perform scalar quantization and/or Huffman encoding to compress the reduced foreground V[k] vectors 55, outputting the coded foreground V[k] vectors 57, which may also be referred to as side channel information 57. The side channel information 57 may include syntax elements used to code the remaining foreground V[k] vectors 55.

Moreover, although described with respect to a form of scalar quantization, the quantization unit 52 may perform vector quantization or any other form of quantization. In some instances, the quantization unit 52 may switch between vector quantization and scalar quantization. During the above described scalar quantization, the quantization unit 52 may compute the difference between two successive V-vectors (successive as in frame-to-frame) and code the difference (or, in other words, residual). This scalar quantization may represent a form of predictive coding based on a previously specified vector and a difference signal. Vector quantization does not involve such difference coding.

In other words, the quantization unit 52 may receive an input V-vector (e.g., one of the reduced foreground V[k] vectors 55) and perform different types of quantization to select one of the types of quantization to be used for the input V-vector. The quantization unit 52 may, as one example, perform vector quantization, scalar quantization without Huffman coding and scalar quantization with Huffman coding.

In this example, the quantization unit 52 may vector quantize the input V-vector according to a vector quantization mode to generate a vector-quantized V-vector. The vector quantized V-vector may include vector-quantized weight values that represent the input V-vector. The vector-quantized weight values may, in some examples, be represented as one or more quantization indices that point to a quantization codeword (i.e., quantization vector) in a quantization codebook of quantization codewords. The quantization unit 52 may, when configured to perform vector quantization, decompose each of the reduced foreground V[k] vectors 55 into a weighted sum of code vectors based on code vectors 63 ("CV 63"). The quantization unit 52 may generate weight values for each of the selected ones of the code vectors 63.

The quantization unit 52 may next select a subset of the weight values to generate a selected subset of weight values. For example, the quantization unit 52 may select the Z greatest-magnitude weight values from the set of weight values to generate the selected subset of the weight valus. In some examples, the quantization unit 52 may further reorder the selected weight values to generate the selected subset of weight values. For example, the quantization unit 52 may reorder the selected weight values based on magnitude starting from a highest-magnitude weight value and ending at a lowest-magnitude weight value.

When performing the vector quantization, the quantization unit 52 may select a Z-component vector from a quantization codebook to represent Z weight values. In other words, the quantization unit 52 may vector quantize Z weight values to generate a Z-component vector that represents the Z weight values. In some examples, Z may correspond to the number of weight values selected by the quantization unit 52 to represent a single V-vector. The quantization unit 52 may generate data indicative of the Z-component vector selected to represent the Z weight values, and provide this data to the bitstream generation unit 42 as the coded weights 57. In some examples, the quantization codebook may include a plurality of Z-component vectors that are indexed, and the data indicative of the Z-component vector may be an index value into the quantization codebook that points to the selected vector. In such examples, the decoder may include a similarly indexed quantization codebook to decode the index value.

Mathematically, each of the reduced foreground V[k] vectors 55 may be represented based on the following expression:

$$V \approx \sum_{j=1}^{J} \omega_j \Omega_j \tag{1}$$

where $\Omega_j$ represents the jth code vector in a set of code vectors ($\{\Omega_j\}$), $\omega_j$ represents the jth weight in a set of weights ($\{\omega_j\}$), V corresponds to the V-vector that is being represented, decomposed, and/or coded by the V-vector coding unit 52, and J represents the number of weights and the number of code vectors used to represent V. The right hand side of expression (1) may represent a weighted sum of code vectors that includes a set of weights ($\{\omega_j\}$) and a set of code vectors ($\{\Omega_j\}$).

In some examples, the quantization unit 52 may determine the weight values based on the following equation:

$$\omega_k = V\,\Omega_k^T \tag{2}$$

where $\Omega_k^T$ represents a transpose of the kth code vector in a set of code vectors ($\{\Omega_k\}$), V corresponds to the V-vector that is being represented, decomposed, and/or coded by the quantization unit 52, and $\omega_k$ represents the kth weight in a set of weights ($\{\omega_k\}$).

Consider an example where 25 weights and 25 code vectors are used to represent a V-vector, $V_{FG}$. Such a decomposition of $V_{FG}$ may be written as:

$$V_{FG} \approx \sum_{j=1}^{25} \omega_j \Omega_j \tag{3}$$

where $\Omega_j$ represents the jth code vector in a set of code vectors ($\{\Omega_j\}$), $\omega_j$ represents the jth weight in a set of weights ($\{\omega_j\}$), and $V_{FG}$ corresponds to the V-vector that is being represented, decomposed, and/or coded by the quantization unit 52.

In examples where the set of code vectors ($\{\Omega_j\}$) is orthonormal, the following expression may apply:

$$\Omega_j \Omega_k^T = \begin{cases} 1 & \text{for } j = k \\ 0 & \text{for } j \neq k \end{cases} \tag{4}$$

In such examples, the right-hand side of equation (3) may simplify as follows:

$$V_{FG}\Omega_k^T \approx \left(\sum_{j=1}^{25} \omega_j \Omega_j\right)\Omega_k^T = \omega_k \tag{5}$$

where $\omega_k$ corresponds to the kth weight in the weighted sum of code vectors.

For the example weighted sum of code vectors used in equation (3), the quantization unit 52 may calculate the weight values for each of the weights in the weighted sum of code vectors using equation (5) (similar to equation (2)) and the resulting weights may be represented as:

$$\{\omega_k\}_{k=1,\ldots,25} \tag{6}$$

Consider an example where the quantization unit 52 selects the five maxima weight values (i.e., weights with greatest values or absolute values). The subset of the weight values to be quantized may be represented as:

$$\{\overline{\omega}_k\}_{k=1,\ldots,5} \tag{7}$$

The subset of the weight values together with their corresponding code vectors may be used to form a weighted sum of code vectors that estimates the V-vector, as shown in the following expression:

$$\overline{V}_{FG} \approx \sum_{j=1}^{5} \overline{\omega}_j \Omega_j \tag{8}$$

where $\Omega_j$ represents the jth code vector in a subset of the code vectors ($\{\Omega_j\}$), $\overline{\omega}_j$ represents the jth weight in a subset of weights ($\{\overline{\omega}_j\}$), and $\overline{V}_{FG}$ corresponds to an estimated V-vector that corresponds to the V-vector being decomposed and/or coded by the quantization unit 52. The right hand side of expression (1) may represent a weighted sum of code vectors that includes a set of weights ($\{\overline{\omega}_j\}$) and a set of code vectors ($\{\Omega_j\}$).

The quantization unit 52 may quantize the subset of the weight values to generate quantized weight values that may be represented as:

$$\{\hat{\omega}_k\}_{k=1,\ldots,5} \tag{9}$$

The quantized weight values together with their corresponding code vectors may be used to form a weighted sum of code vectors that represents a quantized version of the estimated V-vector, as shown in the following expression:

$$\hat{V}_{FG} \approx \sum_{j=1}^{5} \hat{\omega}_j \Omega_j \tag{10}$$

where $\Omega_j$ represents the jth code vector in a subset of the code vectors ($\{\Omega_j\}$), $\hat{\omega}_j$ represents the jth weight in a subset of weights ($\{\omega_j\}$), and $\hat{V}_{FG}$ corresponds to an estimated V-vector that corresponds to the V-vector being decomposed and/or coded by the quantization unit 52. The right hand side of expression (1) may represent a weighted sum of a subset of the code vectors that includes a set of weights ($\{\hat{\omega}_j\}$) and a set of code vectors ($\{\Omega_j\}$).

An alternative restatement of the foregoing (which is largely equivalent to that described above) may be as follows. The V-vectors may be coded based on a predefined set of code vectors. To code the V-vectors, each V-vector is decomposed into a weighted sum of code vectors. The weighted sum of code vectors consists of k pairs of predefined code vectors and associated weights:

$$V \approx \sum_{j=0}^{k} \omega_j \Omega_j \tag{11}$$

where $\Omega_j$ represents the jth code vector in a set of predefined code vectors ($\{\Omega_j\}$), $\omega_j$ represents the jth real-valued weight in a set of predefined weights ($\{\omega_j\}$), k corresponds to the index of addends, which can be up to 7, and V corresponds to the V-vector that is being coded. The choice of k depends on the encoder. If the encoder chooses a weighted sum of two or more code vectors, the total number of predefined code vectors the encoder can chose of is $(N+1)^2$, which predefined code vectors are derived as HOA expansion coefficients from the Tables F.3 to F.7 of the 3D Audio standard entitled "Information technology—High effeciency coding and media delivery in heterogeneous environments—Part 3: 3D audio," by the ISO/IEC JTC 1/SC 29/WG 11, dated Jul. 25, 2014, and identified by document number ISO/IEC DIS 23008-3. When N is 4, the table in Annex F.5 of the above referenced 3D Audio standard with 32 predefined directions is used. In all cases the absolute values of the weights ω are vector-quantized with respect to the predefined weighting values $\hat{\omega}$ found in the first k+1 columns of the table in table F.12 of the above referenced 3D Audio standard and signaled with the associated row number index.

The number signs of the weights ω are separately coded as:

$$s_j = \begin{cases} 1, & \omega_j \geq 0 \\ 0, & \omega_j < 0 \end{cases}. \tag{12}$$

In other words, after signalling the value k, a V-vector is encoded with k+1 indices that point to the k+1 predefined code vectors $\{\Omega_j\}$, one index that points to the k quantized weights $\{\hat{\omega}_k\}$ in the predefined weighting codebook, and k+1 number sign values $s_j$:

$$\hat{V} = \sum_{j=0}^{k} (2s_j - 1)\hat{\omega}_j\Omega_j. \tag{13}$$

If the encoder selects a weighted sum of one code vector, a codebook derived from table F.8 of the above referenced 3D Audio standard is used in combination with the absolute weighting values $\hat{\omega}$ in the table of table F.11 of the above referenced 3D Audio standard, where both of these tables are shown below. Also, the number sign of the weighting value ω may be separately coded. The quantization unit 52 may signal which of the foregoing codebooks set forth in the above noted tables F.3 through F.12 are used to code the input V-vector using a codebook index syntax element (which may be denoted as "CodebkIdx" below). The quantization unit 52 may also scalar quantize the input V-vector to generate an output scalar-quantized V-vector without Huffman coding the scalar-quantized V-vector. The quantization unit 52 may further scalar quantize the input V-vector according to a Huffman coding scalar quantization mode to generate a Huffman-coded scalar-quantized V-vector. For example, the quantization unit 52 may scalar quantize the input V-vector to generate a scalar-quantized V-vector, and Huffman code the scalar-quantized V-vector to generate an output Huffman-coded scalar-quantized V-vector.

In some examples, the quantization unit 52 may perform a form of predicted vector quantization. The quantization unit 52 may identify whether the vector quantization is predicted or not by specifying one or more bits (e.g., the PFlag syntax element) in the bitstream 21 indicating whether prediction is performed for vector quantization (as identified by one or more bits, e.g., the NbitsQ syntax element, indicating a quantization mode).

To illustrate predicted vector quantization, the quantization unit 42 may be configured to receive weight values (e.g., weight value magnitudes) that correspond to a code vector-based decomposition of a vector (e.g., a v-vector), to generate predictive weight values based on the received weight values and based on reconstructed weight values (e.g., reconstructed weight values from one or more previous or subsequent audio frames), and to vector-quantize sets of predictive weight values. In some cases, each weight value in a set of predictive weight values may correspond to a weight value included in a code-vector-based decomposition of a single vector.

The quantization unit 52 may receive a weight value and a weighted reconstructed weight value from a previous or subsequent coding of a vector. The quantization unit 52 may generate a predictive weight value based on the weight value and the weighted reconstructed weight value. The quantization unit 42 may subtract the weighted reconstructed weight value from the weight value to generate the predictive weight value. The predictive weight value may be alternatively referred to as, for example, a residual, a prediction residual, a residual weight value, a weight value difference, an error, or a prediction error.

The weight value may be represented as $|w_{i,j}|$, which is a magnitude (or absolute value) of the corresponding weight value, $w_{i,j}$. As such, the weight value may be alternatively referred to as a weight value magnitude or as a magnitude of a weight value. The weight value, $w_{i,j}$, corresponds to the jth weight value from an ordered subset of weight values for the ith audio frame. In some examples, the ordered subset of weight values may correspond to a subset of the weight values in a code vector-based decomposition of the vector (e.g., v-vector) that are ordered based on magnitude of the weight values (e.g., ordered from greatest magnitude to least magnitude).

The weighted reconstructed weight value may include a $|\hat{w}_{i-1,j}|$ term, which corresponds to a magnitude (or an absolute value) of the corresponding reconstructed weight value, $\hat{w}_{i-1,j}$. The reconstructed weight value, $\hat{w}_{i-1,j}$, corresponds to the jth reconstructed weight value from an ordered subset of reconstructed weight values for the (i−1)th audio frame. In some examples, the ordered subset (or set) of reconstructed weight values may be generated based on quantized predictive weight values that correspond to the reconstructed weight values.

The quantization unit 42 also includes a weighting factor, $\alpha_j$. In some examples, $\alpha_j=1$ in which case the weighted reconstructed weight value may reduce to $|\hat{w}_{i-1,j}|$. In other examples, $\alpha_j \neq 1$. For example, $\alpha_j$ may be determined based on the following equation:

$$\alpha_j = \frac{\sum_{i=1}^{l} w_{i,j} w_{i-1,j}}{\sum_{i=1}^{l} w_{i-1,j}^2}$$

where l corresponds to the number of audio frames used to determine $\alpha_j$. As shown in the previous equation, the weighting factor, in some examples, may be determined based on a plurality of different weight values from a plurality of different audio frames.

Also when configured to perform predicted vector quantization, the quantization unit 52 may generate the predictive weight value based on the following equation:

$$e_{i,j}=|w_{i,j}|-\alpha_j|\hat{w}_{i-1,j}|$$

where $e_{i,j}$ corresponds to the predictive weight value for the jth weight value from an ordered subset of weight values for the ith audio frame.

The quantization unit 52 generates a quantized predictive weight value based on the predictive weight value and a predicted vector quantization (PVQ) codebook. For example, the quantization unit 52 may vector quantize the predictive weight value in combination with other predictive weight values generated for the vector to be coded or for the frame to be coded in order to generate the quantized predictive weight value.

The quantization unit 52 may vector quantize the predictive weight value 620 based on the PVQ codebook. The PVQ codebook may include a plurality of M-component candidate quantization vectors, and the quantization unit 52 may select one of the candidate quantization vectors to represent Z predictive weight values. In some examples, the quantization unit 52 may select a candidate quantization vector from the PVQ codebook that minimizes a quantization error (e.g., minimizes a least squares error).

In some examples, the PVQ codebook may include a plurality of entries where each of the entries includes a quantization codebook index and a corresponding M-component candidate quantization vector. Each of the indices in the quantization codebook may correspond to a respective one of a plurality of M-component candidate quantization vectors.

The number of components in each of the quantization vectors may be dependent on the number of weights (i.e., Z) that are selected to represent a single v-vector. In general, for a codebook with Z-component candidate quantization vectors, the quantization unit 52 may vector quantize Z predictive weight values at a time to generate a single quantized vector. The number of entries in the quantization codebook may be dependent upon the bit-rate used to vector quantize the weight values.

When the quantization unit 52 vector quantizes the predictive weight value, the quantization unit 52 may select an Z-component vector from the PVQ codebook to be the quantization vector that represents Z predictive weight values. The quantized predictive weight value may be denoted as $\hat{e}_{i,j}$, which may correspond to the jth component of the Z-component quantization vector for the ith audio frame, which may further correspond to a vector-quantized version of the jth predictive weight value for the ith audio frame.

When configured to perform predicted vector quantization, the quantization unit 52 also may generate a reconstructed weight value based on the quantized predictive weight value and the weighted reconstructed weight value. For example, the quantization unit 52 may add the weighted reconstructed weight value to the quantized predictive weight value to generate the reconstructed weight value. The weighted reconstructed weight value may be identical to the weighted reconstructed weight value, which is described above. In some examples, the weighted reconstructed weight value may be a weighted and delayed version of the reconstructed weight value.

The reconstructed weight value may be represented as $|\hat{w}_{i-1,j}|$, which corresponds to a magnitude (or an absolute value) of the corresponding reconstructed weight value, $\hat{w}_{i-1,j}$. The reconstructed weight value, $\hat{w}_{i-1,j}$, corresponds to the jth reconstructed weight value from an ordered subset of reconstructed weight values for the (i−1)th audio frame. In some examples, the quantization unit 52 may separately code data indicative of the sign of a weight value that is predictively coded, and the decoder may use this information to determine the sign of the reconstructed weight value.

The quantization unit 52 may generate the reconstructed weight value based on the following equation:

$$|\hat{w}_{i,j}|=\hat{e}_{i,j}+\alpha_j|\hat{w}_{i-1,j}|$$

where $\hat{e}_{i,j}$ corresponds to a quantized predictive weight value for the jth weight value from an ordered subset of weight values (e.g. the jth component of an M-component quantization vector) for the ith audio frame, $|\hat{w}_{i-1,j}|$ corresponds to a magnitude of a reconstructed weight value for the jth weight value from an ordered subset of weight values for the (i−1)th audio frame, and $\alpha_j$ corresponds to a weighting factor for the jth weight value from an ordered subset of weight values.

The quantization unit 52 may generate a delayed reconstructed weight value based on the reconstructed weight value. For example, the quantization unit 52 may delay the reconstructed weight value by one audio frame to generate the delayed reconstructed weight value.

The quantization unit 52 also may generate the weighted reconstructed weight value based the delayed reconstructed weight value and the weighting factor. For example, the quantization unit 52 may multiply the delayed reconstructed weight value by the weighting factor to generate the weighted reconstructed weight value.

Similarly, the quantization unit 52 generates the weighted reconstructed weight value based the delayed reconstructed weight value and the weighting factor. For example, the quantization unit 52 may multiply the delayed reconstructed weight value by the weighting factor to generate the weighted reconstructed weight value.

In response to selecting a Z-component vector from the PVQ codebook to be a quantization vector for Z predictive weight values, the quantization unit 52 may, in some examples, code the index (from the PVQ codebook) that corresponds to the selected Z-component vector instead of coding the selected Z-component vector itself. The index may be indicative of a set of quantized predictive weight values. In such examples, the decoder 24 may include a codebook similar to the PVQ codebook, and may decode the index indicative of the quantized predictive weight values by mapping the index to a corresponding Z-component vector in the decoder codebook. Each of the components in the Z-component vector may correspond to a quantized predictive weight value.

Scalar quantizing a vector (e.g., a V-vector) may involve quantizing each of the components of the vector individually and/or independently of the other components. For example, consider the following example V-vector:

$$V=[0.23\ 0.31\ -0.47\ .\ .\ .\ 0.85]$$

To scalar quantize this example V-vector, each of the components may be individually quantized (i.e., scalar-quantized). For example, if the quantization step is 0.1, then the 0.23 component may be quantized to 0.2, the 0.31 component may be quantized to 0.3, etc. The scalar-quantized components may collectively form a scalar-quantized V-vector.

In other words, the quantization unit 52 may perform uniform scalar quantization with respect to all of the elements of the given one of the reduced foreground V[k] vectors 55. The quantization unit 52 may identify a quantization step size based on a value, which may be denoted as an NbitsQ syntax element. The quantization unit 52 may dynamically determine this NbitsQ syntax element based on the target bitrate 41. The NbitsQ syntax element may also identify the quantization mode as noted in the ChannelSideInfoData syntax table reproduced below, while also identifying for purposes of scalar quantization the step size. That is, the quantization unit 52 may determining the quantization step size as a function of this NbitsQ syntax element. As one example, the quantization unit 52 may determine the quantization step size (denoted as "delta" or "Δ" in this disclosure) as equal to $2^{16-NbitsQ}$. In this example, when the value of the NbitsQ syntax element equals six, delta equals $2^{10}$ and there are $2^6$ quantization levels. In this respect, for a vector element v, the quantized vector element $v_q$ equals [v/Δ] and $-2^{NbitsQ-1}<v_q<2^{NbitsQ-1}$.

The quantization unit 52 may then perform categorization and residual coding of the quantized vector elements. As one example, the quantization unit 52 may, for a given quantized vector element $v_q$ identify a category (by determining a category identifier cid) to which this element corresponds using the following equation:

$$cid = \begin{cases} 0, & \text{if } v_q = 0 \\ \lfloor \log_2 |v_q| \rfloor + 1, & \text{if } v_q \neq 0 \end{cases}$$

The quantization unit 52 may then Huffman code this category index cid, while also identifying a sign bit that indicates whether $v_q$ is a positive value or a negative value. The quantization unit 52 may next identify a residual in this category. As one example, the quantization unit 52 may determine this residual in accordance with the following equation:

$$\text{residual} = |v_q| - 2^{cid-1}$$

The quantization unit 52 may then block code this residual with cid−1 bits.

The quantization unit 52 may, in some examples, select different Huffman code books for different values of NbitsQ syntax element when coding the cid. In some examples, the quantization unit 52 may provide a different Huffman coding table for NbitsQ syntax element values 6, . . . , 15. Moreover, the quantization unit 52 may include five different Huffman code books for each of the different NbitsQ syntax element values ranging from 6, . . . , 15 for a total of 50 Huffman code books. In this respect, the quantization unit 52 may include a plurality of different Huffman code books to accommodate coding of the cid in a number of different statistical contexts.

To illustrate, the quantization unit 52 may, for each of the NbitsQ syntax element values, include a first Huffman code book for coding vector elements one through four, a second Huffman code book for coding vector elements five through nine, a third Huffman code book for coding vector elements nine and above. These first three Huffman code books may be used when the one of the reduced foreground V[k] vectors 55 to be compressed is not predicted from a temporally subsequent corresponding one of the reduced foreground V[k] vectors 55 and is not representative of spatial information of a synthetic audio object (one defined, for example, originally by a pulse code modulated (PCM) audio object). The quantization unit 52 may additionally include, for each of the NbitsQ syntax element values, a fourth Huffman code book for coding the one of the reduced foreground V[k] vectors 55 when this one of the reduced foreground V[k] vectors 55 is predicted from a temporally subsequent corresponding one of the reduced foreground V[k] vectors 55. The quantization unit 52 may also include, for each of the NbitsQ syntax element values, a fifth Huffman code book for coding the one of the reduced foreground V[k] vectors 55 when this one of the reduced foreground V[k] vectors 55 is representative of a synthetic audio object. The various Huffman code books may be developed for each of these different statistical contexts, i.e., the non-predicted and non-synthetic context, the predicted context and the synthetic context in this example.

The following table illustrates the Huffman table selection and the bits to be specified in the bitstream to enable the decompression unit to select the appropriate Huffman table:

| Pred mode | HT info | HT table |
|---|---|---|
| 0 | 0 | HT5 |
| 0 | 1 | HT{1, 2, 3} |
| 1 | 0 | HT4 |
| 1 | 1 | HT5 |

In the foregoing table, the prediction mode ("Pred mode") indicates whether prediction was performed for the current vector, while the Huffman Table ("HT info") indicates additional Huffman code book (or table) information used to select one of Huffman tables one through five. The prediction mode may also be represented as the PFlag syntax element discussed below, while the HT info may be represented by the CbFlag syntax element discussed below.

The following table further illustrates this Huffman table selection process given various statistical contexts or scenarios.

| | Recording | Synthetic |
|---|---|---|
| W/O Pred | HT{1, 2, 3} | HT5 |
| With Pred | HT4 | HT5 |

In the foregoing table, the "Recording" column indicates the coding context when the vector is representative of an audio object that was recorded while the "Synthetic" column indicates a coding context for when the vector is representative of a synthetic audio object. The "W/O Pred" row indicates the coding context when prediction is not performed with respect to the vector elements, while the "With Pred" row indicates the coding context when prediction is performed with respect to the vector elements. As shown in this table, the quantization unit 52 selects HT{1, 2, 3} when the vector is representative of a recorded audio object and prediction is not performed with respect to the vector elements. The quantization unit 52 selects HT5 when the audio object is representative of a synthetic audio object and prediction is not performed with respect to the vector elements. The quantization unit 52 selects HT4 when the vector is representative of a recorded audio object and prediction is performed with respect to the vector elements. The quantization unit 52 selects HT5 when the audio object is representative of a synthetic audio object and prediction is performed with respect to the vector elements.

The quantization unit 52 may select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector as discussed in more detail below with respect to the example of FIGS. 4 and 7.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the sound field analysis unit the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER ORDER AMBISONIC COEFFICIENTS," filed Jan. 12, 2015.

Figure 4:
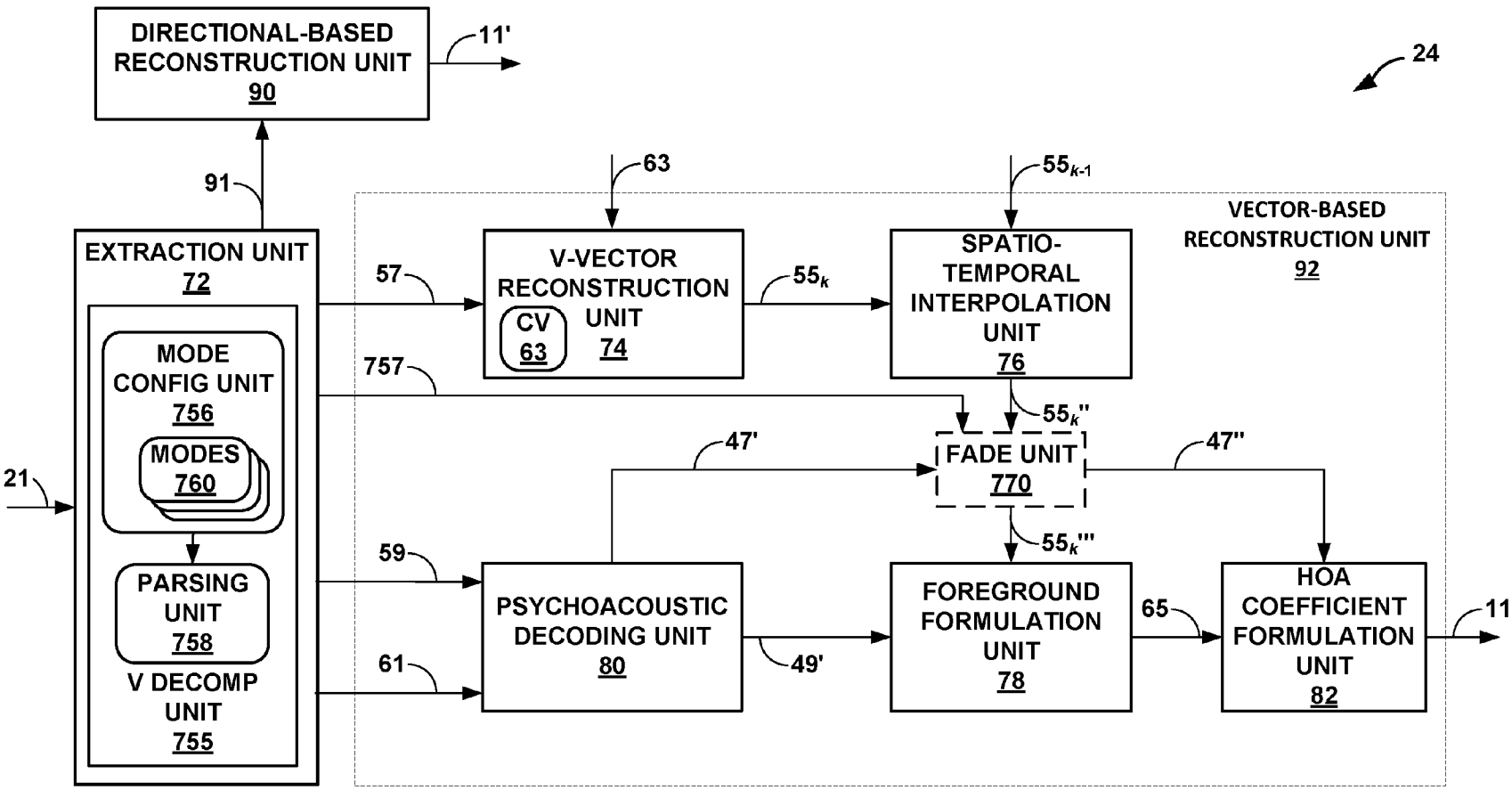
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11.

The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91. The bitstream and the arrangement of syntax elements within the bitstream is described below in more detail with respect to the example of FIGS. 7A-7J.

When the syntax element indicates that the HOA coefficients 11 were encoded using a vector-based synthesis, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

To extract the coded foreground V[k] vectors 57, the extraction unit 72 may extract the syntax elements in accordance with the following ChannelSideInfoData (CSID) syntax table.

TABLE

Syntax of ChannelSideInfoData(i)

| Syntax | No. of bits | Mnemonic |
|---|---|---|
| ChannelSideInfoData(i) | | |
| { | | |
| ChannelType[i] | 2 | uimsbf |
| switch ChannelType[i] | | |
| { | | |
| case 0: | | |
| ActiveDirsIds[i]; | NumOfBits PerDirIdx | uimsbf |
| break; | | |
| case 1: | | |
| bA; | 1 | bslbf |
| bB; | 1 | bslbf |
| if ((bA + bB) == 0) { | | |
| NbitsQ(k)[i] = NbitsQ(k−1)[i]; | | |
| PFlag(k)[i] = PFlag(k−1)[i]; | | |
| CbFlag(k)[i] = CbFlag(k−1)[i]; | | |
| CodebkIdx(k)[i] = CodebkIdx(k−1)[i]; | | |
| NumVecIndices(k)[i] = NumVecIndices[k−1][i]; | | |
| } | | |
| else{ | | |
| NbitsQ(k)[i] = (8*bA)+(4*bB)+uintC; | 2 | uimsbf |
| if (NbitsQ(k)[i] == 4) { | | |
| PFlag(k)[i]; | 1 | bslbf |
| CodebkIdx(k)[i]; | 3 | uimsbf |
| NumVecIndices(k)[i]++; | NumVVec VqElementsBits | uimsbf |
| } | | |
| elseif (NbitsQ(k)[i] >= 6) { | | |
| PFlag(k)[i]; | 1 | bslbf |
| CbFlag(k)[i]; | 1 | bslbf |
| } | | |
| } | | |
| } | | |
| break; | | |
| case 2: | | |
| AddAmbHoaInfoChannel(i); | | |
| break; | | |
| default: | | |
| } | | |
| } | | |

The semantics for the foregoing table are as follows. This payload holds the side information for the i-th channel. The size and the data of the payload depend on the type of the channel.

| | |
|---|---|
| ChannelType[i] | This element stores the type of the i-th channel which is defined in Table 95. |
| ActiveDirsIds[i] | This element indicates the direction of the active directional signal using an index of the 900 predefined, uniformly distributed points from |

-continued

| | |
|---|---|
| | Annex F.7. The code word 0 is used for signaling the end of a directional signal. |
| PFlag[i] | The prediction flag associated with the Vector-based signal of the i-th channel. |
| CbFlag[i] | The codebook flag used for the Huffman decoding of the scalar-quantised V-vector associated with the Vector-based signal of the i-th channel. |
| CodebkIdx[i] | Signals the specific codebook used to dequantise the vector-quantized V-vector associated with the Vector-based signal of the i-th channel. |
| NbitsQ[i] | This index determines the Huffman table used for the Huffman decoding of the data associated with the Vector-based signal of the i-th channel. The code word 5 determines the use of a uniform 8 bit dequantizer. The two MSBs 00 determines reusing the NbitsQ[i], PFlag[i] and CbFlag[i] data of the previous frame (k − 1). |
| bA, bB | The msb (bA) and second msb (bB) of the NbitsQ[i] field. |
| uintC | The code word of the remaining two bits of the NbitsQ[i] field. |
| NumVecIndices | The number of vectors used to dequantize a vector-quantized V-vector. |
| AddAmbHoaInfoChannel(i) | This payload holds the information for additional ambient HOA coefficients. |

In accordance with the CSID syntax table, the extraction unit 72 may first obtain a ChannelType syntax element indicative of the type of channel (e.g., where a value of zero signals a directional-based signal, a value of 1 signals a vector-based signal, and a value of 2 signals an additional ambient HOA signal). Based on the ChannelType syntax element, the extraction unit 72 may switch between the three cases.

Focusing on case 1 to illustrate one example of the techniques described in this disclosure, the extraction unit 72 may obtain the most significant bit of the NbitsQ syntax element (i.e., the bA syntax element in the above example CSID syntax table) and the second most significant bit of the NbitsQ syntax element (i.e., the bB syntax element in the above example CSID syntax table). The (k)[i] of NbitsQ(k)[i] may denote that the NbitsQ syntax element is obtained for the $k^{th}$ frame of the $i^{th}$ transport channel. The NbitsQ syntax element may represent one or more bits indicative of a quantization mode used to quantize the spatial component of the soundfield represented by the HOA coefficients 11. The spatial component may also be referred to as a V-vector in this disclosure or as the coded foreground V[k] vectors 57.

In the example CSID syntax table above, the NbitsQ syntax element may include four bits to indicate one of 12 quantization modes (as a value of zero through three for the NbitsQ syntax element are reserved or unused) used to compress the vector specified in the corresponding VVecData field. The 12 quantization modes include the following indicated below:

0-3: Reserved

4: Vector Quantization

5: Scalar Quantization without Huffman Coding

6: 6-bit Scalar Quantization with Huffman Coding

7: 7-bit Scalar Quantization with Huffman Coding

8: 8-bit Scalar Quantization with Huffman Coding . . . . . .

16: 16-bit Scalar Quantization with Huffman Coding

In the above, the value of the NbitsQ syntax element from 6-16 indicates, not only that scalar quantization is to be performed with Huffman coding, but also the quantization step size of the scalar quantization. In this respect, the quantization mode may comprise a vector quantization mode, a scalar quantization mode without Huffman coding and a scalar quantization mode with Huffman coding.

Returning to the example CSID syntax table above, the extraction unit 72 may combine the bA syntax element with the bB syntax element, where this combination may be an addition as shown in the above example CSID syntax table. The combined bA/bB syntax element may represent an indicator for whether to reuse, from a previous frame, at least one syntax element indicative of information used when compressing the vector. The extraction unit 72 next compares the combined bA/bB syntax element to a value of zero. When the combined bA/bB syntax element has a value of zero, the extraction unit 72 may determine that the quantization mode information for the current $k^{th}$ frame of the $i^{th}$ transport channel (i.e., the NbitsQ syntax element indicative of the quantization mode in the above example CSID syntax table) is the same as quantization mode information of the $k-1^{th}$ frame of the $i^{th}$ transport channel. In other words, the indicator, when set to a zero value, indicates to resuse the at least one syntax element from the previous frame.

The extraction unit 72 similarly determines that the prediction information for the current $k^{th}$ frame of the $i^{th}$ transport channel (i.e., the PFlag syntax element indicative of whether prediction is performed during either vector quantization or scalar quantization in the example) is the same as prediction information of the $k-1^{th}$ frame of the $i^{th}$ transport channel. The extraction unit 72 may also determine that the Huffman codebook information for the current $k^{th}$ frame of the $i^{th}$ transport channel (i.e., the CbFlag syntax element indicative of a Huffman codebook used to reconstruct the V-vector) is the same as Huffman codebook information of the $k-1^{th}$ frame of the $i^{th}$ transport channel. The extraction unit 72 may also determine that the vector quantization information for the current $k^{th}$ frame of the $i^{th}$ transport channel (i.e., the CodebkIdx syntax element indicative of a vector quantization codebook used to reconstruct the V-vector and the NumVecIndices syntax element indicative of a number of code vectors used to reconstruct the V-vector) is the same as vector quantization information of the $k-1^{th}$ frame of the $i^{th}$ transport channel.

When the combined bA/bB syntax element does not have a value of zero, the extraction unit 72 may determine that the quantization mode information, the prediction information, the Huffman codebook information and the vector quantization information for the $k^{th}$ frame of the $i^{th}$ transport channel is not the same as that of the $k-1^{th}$ frame of the $i^{th}$ transport channel. As a result, the extraction unit 72 may obtain the least significant bits of the NbitsQ syntax element (i.e., the uintC syntax element in the above example CSID syntax table), combining the bA, bB and uintC syntax element to obtain the NbitsQ syntax element. Base on this NbitsQ syntax element the extraction unit 72 may obtain either, when the NbitsQ syntax element signals vector quantization, the PFlag, CodebkIdx, and NumVecIndices syntax elements or, when the NbitsQ syntax element signals scalar quantization with Huffman coding, the PFlag and CbFlag syntax elements. In this way, the extraction unit 72 may extract the foregoing syntax elements used to reconstruct the V-vector, passing these syntax elements to the vector-based reconstruction unit 72.

The extraction unit 72 may next extract the V-vector from the $k^{th}$ frame of the $i^{th}$ transport channel. The extraction unit 72 may obtain an HOADecoderConfig container, which includes the syntax element denoted CodedVVecLength. The extraction unit 72 may parse the CodedVVecLength from the HOADecoderConfig container. The extraction unit 72 may obtain the V-vector in accordance with the following VVecData syntax table.

```
Syntax                                                          No. of bits Mnemonic
VVectorData(i)
{
    if (NbitsQ(k)[i] == 4){
        if (NumVecIndices(k)[i] == 1) {
            VecIdx[0] = VecIdx + 1;                                  10     uimsbf
            WeightVal[0] = ((SgnVal*2)-1);                            1     uimsbf
        } else {
            WeightIdx;                                            nbitsW   uimsbf
            nbitsIdx = ceil(log2(NumOfHoaCoeffs));
            for (j=0; j< NumVecIndices(k)[i]; ++j) {
                VecIdx[j] = VecIdx + 1;                           nbitsIdx uimsbf
                if (PFlag[i] == 0) {
                  tmpWeightVal(k) [j] =
                  WeightValCdbk[CodebkIdx(k)[i]][WeightIdx][j];
                else {
                   tmpWeightVal(k) [j] =
            WeightValPredCdbk[CodebkIdx(k)[i]][WeightIdx][j]
                + WeightValAlpha[j] * tmpWeightVal(k-1) [j];
                }
                WeightVal[j] = ((SgnVal*2)-1) *                       1     uimsbf
                tmpWeightVal(k) [j];
            }
        }
    }
    else if (NbitsQ(k)[i] == 5) {
        for (m=0; m< VVecLength; ++m)
            aVal[i][m] = (VecVal / 128.0) - 1.0;                      8     uimsbf
    }
    else if(NbitsQ(k)[i] >= 6) {
        for (m=0; m< VVecLength; ++m){
            huffIdx = huffSelect(VVecCoeffId[m], PFlag[i],
            CbFlag[i]);
            cid = huffDecode(NbitsQ[i], huffIdx, huffVal);        dynamic  huffDecode
            aVal[i][m] = 0.0;
            if ( cid > 0 ) {
                aVal[i][m] = sgn = (SgnVal * 2) - 1;                  1     bslbf
                if (cid > 1) {
                    aVal[i][m] = sgn * (2.0^(cid -1 ) +           cid-1    uimsbf
                    intAddVal);
                }
            }
        }
    }
}
```

NOTE:
See Error! Reference source not found. for computation of VVecLength

VVec(k)[i] This is the V-vector for the k-th HOAframe( ) for the i-th channel.

VVecLength This variable indicates the number of vector elements to read out.

VVecCoeffId This vector contains the indices of the transmitted V-vector coefficients.

VecVal An integer value between 0 and 255.

aVal A temporary variable used during decoding of the VVectorData.

huffVal A Huffman code word, to be Huffman-decoded.

SgnVal This is the coded sign value used during decoding.

intAddVal This is additional integer value used during decoding.

NumVecIndices The number of vectors used to dequantize a vector-quantized V-vector.

WeightIdx The index in WeightValCdbk used to dequantize a vector-quantized V-vector.

nBitsW Field size for reading WeightIdx to decode a vector-quantized V-vector.

WeightValCbk Codebook which contains a vector of positive real-valued weighting coefficients. Only necessary if NumVecIndices is >1. The WeightValCdbk with 256 entries is provided.

WeightValPredCdbk Codebook which contains a vector of predictive weighting coefficients. Only necessary if NumVecIndices is >1. The WeightValPredCdbk with 256 entries is provided.

WeightValAlpha Predictive coding coefficients that are used for the predictive coding mode of the V-vector quantization.

VvecIdx An index for VecDict, used to dequantize a vector-quantized V-vector.

nbitsIdx Field size for reading VvecIdx to decode a vector-quantized V-vector.

WeightVal A real-valued weighting coefficient to decode a vector-quantized V-vector.

In the foregoing syntax table, the extraction unit 72 may determine whether the value of the NbitsQ syntax element equals four (or, in other words, signals that vector dequantization is used to reconstruct the V-vector). When the value of the NbitsQ syntax element equals four, the extraction unit 72 may compare the value of the NumVecIndices syntax element to a value of one. When the value of the NumVecIndices equals one, the extraction unit 72 may obtain a VecIdx syntax element. The VecIdx syntax element may represent one or more bits indicative of an index for a VecDict used to dequantize a vector quantized V-vector. The extraction unit 72 may instantiate a VecIdx array, with the zero-th element set to the value of the VecIdx syntax element plus one. The extraction unit 72 may also obtain a SgnVal syntax element. The SgnVal syntax element may represent one or more bits indicative of a coded sign value used during decoding of the V-vector. The extraction unit 72 may instantiate a WeightVal array, setting the zero-th element as a function of the value of the SgnVal syntax element.

When the value of the NumVecIndices syntax element is not equal to a value of one, the extraction unit 72 may obtain a WeightIdx syntax element. The WeightIdx syntax element may represent one or more bits indicative of an index in the WeightValCdbk array used to dequantize a vector quantized V-vector. The WeightValCdbk array may represent a codebook that contains a vector of positive real-valued weighting coefficients. The extraction unit 72 may next determine an nbitsIdx as a function of a NumOfHoaCoeffs syntax element specified in the HOAConfig container (specified as one example at the start of the bitstream 21). The extraction unit 72 may then iterate through the NumVecIndices, obtaining a VecIdx syntax element from the bitstream 21 and setting the VecIdx array elements with each obtained VecIdx syntax element.

The extraction unit 72 does not perform the following PFlag syntax comparison, which involve determining tmpWeightVal variable values that are unrelated to extraction of syntax elements from the bitstream 21. As such, the extraction unit 72 may next obtain the SgnVal syntax element for use in determining a WeightVal syntax element.

When the value of the NbitsQ syntax element equals five (signaling that scalar dequantization without Huffman decoding is used to reconstruct the V-vector), the extraction unit 72 iterates from 0 to the VVecLength, setting the aVal variable to the VecVal syntax element obtained from the bitstream 21. The VecVal syntax element may represent one or more bits indicative of an integer between 0 and 255.

When the value of the NbitsQ syntax element is equal to or greater than six (signaling that NbitsQ-bit scalar dequantization with Huffman decoding is used to reconstruct the V-vector), the extraction unit 72 iterates from 0 to the VVecLength, obtaining one or more of the huffVal, SgnVal, and intAddVal syntax elements. The huffVal syntax element may represent one or more bits indicative of a Huffman code word. The intAddVal syntax element may represent one or more bits indicative of an additional integer values used during decoding. The extraction unit 72 may provide these syntax elements to the vector-based reconstruction unit 92.

The vector-based reconstruction unit 92 may represents a unit configured to perform operations reciprocal to those described above with respect to the vector-based synthesis unit 27 so as to reconstruct the HOA coefficients 11'. The vector based reconstruction unit 92 may include a V-vector reconstruction unit 74, a spatio-temporal interpolation unit 76, a foreground formulation unit 78, a psychoacoustic decoding unit 80, a HOA coefficient formulation unit 82, a fade unit 770, and a reorder unit 84. The dashed lines of the fade unit 770 indicates that fade unit 770 may be an optional unit in terms of being included in the vector-based reconstruction unit 92.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The V-vector reconstruction unit 74 may, in other words, operate in accordance with the following pseudocode to reconstruct the V-vectors:

```
if (NbitsQ(k)[i] == 4){
  if (NumVvecIndicies == 1){
    for (m=0; m< VVecLength; ++m){
      idx = VVecCoeffID[m];
      v^(i)_VVecCoeffId[m](k) = WeightVal[0] *
      VecDict[900].[VecIdx[0]][idx];
    }
  } else {
    cdbLen = O;
    if (N==4)
      cdbLen = 32;
    if
    for (m=0; m< O; ++m){
      TmpVVec[m] = 0;
      for (j=0; j< NumVecIndecies; ++j){
        TmpVVec[m] += WeightVal[j] *
        VecDict[cdbLen].[VecIdx[j]][m];
      }
    }
    FNorm = 0.0;
    for (m=0; m < O; ++ m) {
      FNorm += TmpVVec[m] * TmpVVec[m];
    }
    FNorm = (N+1)/sqrt(FNorm);
    for (m=0; m< VVecLength; ++m){
        idx = VVecCoeffID[m];
        v^(i)_VVecCoeffId[m](k) = TmpVVec[idx] * FNorm;
    }
  }
}
elseif (NbitsQ(k)[i] == 5){
  for (m=0; m< VVecLength; ++m){
    v^(i)_VVecCoeffId[m](k) = (N+1)*aVal[i][m];
  }
}
elseif (NbitsQ(k)[i] >= 6){
  for (m=0; m< VVecLength; ++m){
    v^(i)_VVecCoeffId[m](k) = (N+1)*(2^(16 - NbitsQ(k)[i])*aVal[i][m])/2^15;
    if (PFlag(k)[i] == 1) {
      v^(i)_VVecCoeffId[m](k) += v^(i)_VVecCoeffId[m](k - 1) ;
    }
  }
}
```

According to the foregoing pseudocode, the V-vector reconstruction unit 74 may obtain the NbitsQ syntax element for the $k^{th}$ frame of the $i^{th}$ transport channel. When the NbitsQ syntax element equals four (which, again, signals that vector quantization was performed), the V-vector reconstruction unit 74 may compare the NumVecIndicies syntax element to one. The NumVecIndicies syntax element may, as described above, represent one or more bits indicative of a number of vectors used to dequantize a vector-quantized V-vector. When the value of the NumVecIndicies syntax element equals one, the V-vector reconstruction unit 74 may then iterate from zero up to the value of the VVecLength syntax element, setting the idx variable to the VVecCoeffId and the $VVecCoeffId^{th}$ V-vector element ($v^{(i)}_{VVecCoeffId[m]}(k)$) to the WeightVal multiplied by the VecDict entry identified by the [900][VecIdx[0]][idx]. In other words, when the value of NumVvecIndicies is equal to one, the Vector codebook HOA expansion coefficients derived from the table F.8 in conjunction with a codebook of 8×1 weighting values shown in the table F.11.

When the value of the NumVecIndicies syntax element does not equal one, the V-vector reconstruction unit 74 may set the cdbLen variable to O, which is a variable denoting the number of vectors. The cdbLen syntax element indicates the number of entries in the dictionary or codebook of code vectors (where this dictionary is denoted as "VecDict" in the foregoing pseudocode and represents a codebook with cdbLen codebook entries containing vectors of HOA expansion coefficients, used to decode a vector quantized V-vector). When the order (denoted by "N") of the HOA coefficients 11 equals four, the V-vector reconstruction unit 74 may set the cdbLen variable to 32. The V-vector reconstruction unit 74 may next iterate from zero through O, setting a TmpVVec array to zero. During this iterations, the v-vector reconstruction unit 74 may also iterate from zero to the value of the NumVecIndecies syntax element, setting the $m^{th}$ entry of the TempVVec array to be equal to the $j^{th}$ WeightVal multiplied by the [cdbLen][VecIdx[j]][m] entry of the VecDict.

The V-vector reconstruction unit 74 may derive the WeightVal according to the following pseudocode:

```
for (j=0; j< NumVecIndices(k)[i]; ++j) {
  if (PFlag[i] == 0) {
    tmpWeightVal(k) [j] =
      WeightValCdbk[CodebkIdx(k)[i]][WeightIdx][j];
  else {
    tmpWeightVal(k) [j] =
      WeightValPredCdbk[CodebkIdx(k)[i]][WeightIdx][j]
      + WeightValAlpha[j]*tmpWeightVal(k−1) [j];
  }
  WeightVal[j] = ((SgnVal*2)−1) * tmpWeightVal(k) [j];
```

In the foregoing pseudocode, the V-vector reconstruction unit 74 may iterate from zero up to the value of the NumVecIndices syntax element, first determining whether the value of the PFlag syntax element equals zero. When the PFlag syntax element equals zero, the V-vector reconstruction unit 74 may determine a tmpWeightVal variable, setting the tmpWeightVal variable equal to the [CodebkIdx][WeightIdx] entry of the WeightValCdbk codebook. When the value of the PFlag syntax element is not equal to zero, the V-vector reconstruction unit 74 may set the tmpWeightVal variable equal to [CodebkIdx][WeightIdx] entry of the WeightValPredCdbk codebook plus the WeightValAlpha variable multiplied by the tempWeightVal of the $k-1^{th}$ frame of the $i^{th}$ transport channel. The WeightValAlpha variable may refer to the above noted alpha value, which may be statically defined at the audio encoding and decoding devices 20 and 24. The V-vector reconstruction unit 74 may then obtain the WeightVal as a function of the SgnVal syntax element obtained by the extraction unit 72 and the tmpWeightVal variable.

The V-vector reconstruction unit 74 may, in other words, derive the weight value for each corresponding code vector used to reconstruct the V-vector based on a weight value codebook (denoted as "WeightValCdbk" for non-predicted vector quantization and "WeightValPredCdbk" for predicted vector quantization, both of which may represent a multi-dimensional table indexed based on one or more of a codebook index (denoted "CodebkIdx" syntax element in the foregoing VVectorData(i) syntax table) and a weight index (denoted "WeightIdx" syntax element in the foregoing VVectorData(i) syntax table)). This CodebkIdx syntax element may be defined in a portion of the side channel information, as shown in the below Channel SideInfoData(i) syntax table.

The remaining vector quantization portion of the above pseudocode relates to calculation of an FNorm to normalize the elements of the V-vector followed by a computation of the V-vector element ($v^{(i)}_{VVecCoeffId[m]}(k)$) as being equal to TmpVVec[idx] multiplied by the FNorm. The V-vector reconstruction unit 74 may obtain the idx variable as a function fo the VVecCoeffID.

When NbitsQ equals 5, a uniform 8 bit scalar dequantization is performed. In contrast, an NbitsQ value of greater or equals 6 may result in application of Huffman decoding. The cid value referred to above may be equal to the two least significant bits of the NbitsQ value. The prediction mode is denoted as the PFlag in the above syntax table, while the Huffman table info bit is denoted as the CbFlag in the above syntax table. The remaining syntax specifies how the decoding occurs in a manner substantially similar to that described above.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'''" or "ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $55_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $55_k''$. The fade unit 770 may output adjusted ambient HOA coefficients 47" to the HOA coefficient formulation unit 82 and adjusted foreground V[k] vectors $55_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $55_k''$.

The foreground formulation unit 78 may represent a unit configured to perform matrix multiplication with respect to the adjusted foreground V[k] vectors $55_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $55_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $55_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5A:
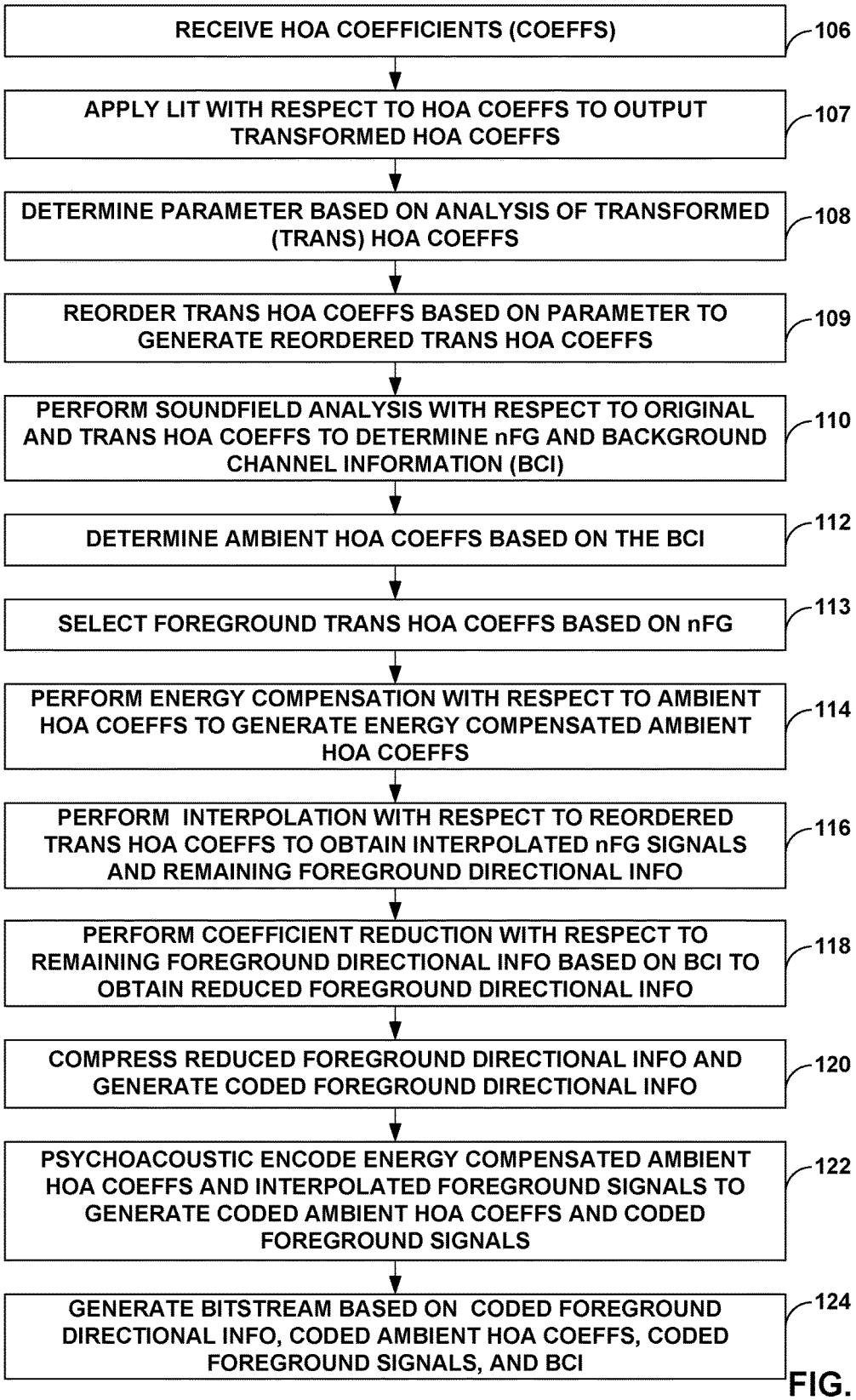
FIG. 5A is a flowchart illustrating exemplary operation of an audio encoding device in performing various aspects of the vector-based synthesis techniques described in this disclosure.

FIG. 5A is a flowchart illustrating exemplary operation of an audio encoding device, such as the audio encoding device 20 shown in the example of FIG. 3, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49'") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 5B:
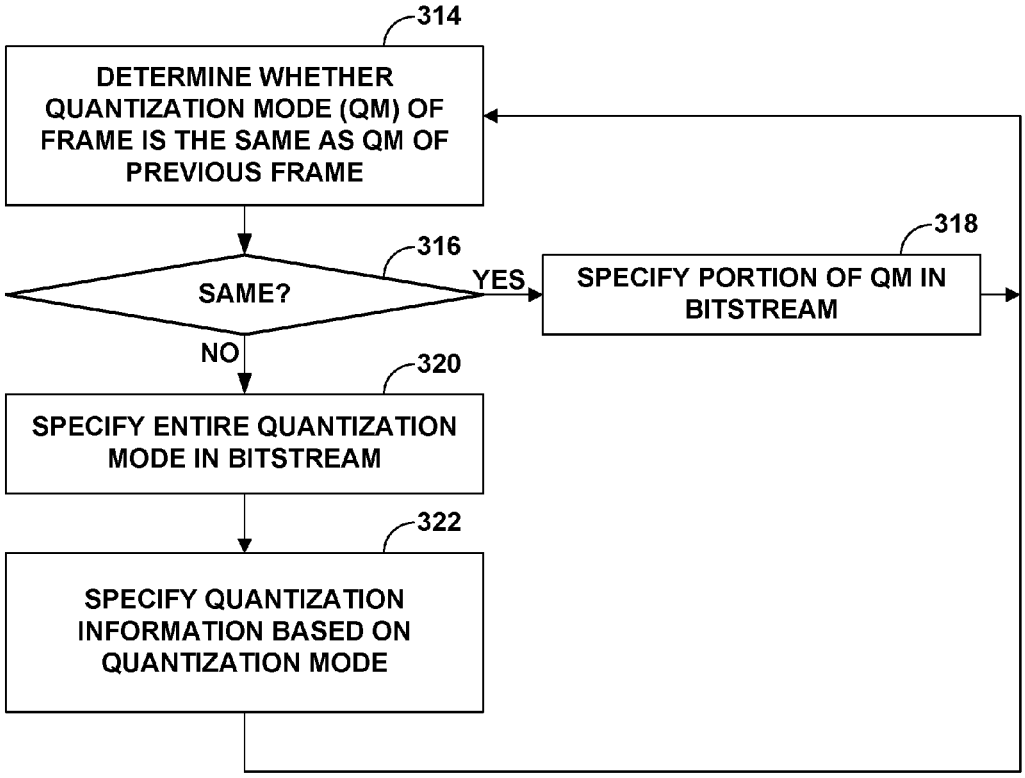
FIG. 5B is a flowchart illustrating exemplary operation of an audio encoding device in performing various aspects of the coding techniques described in this disclosure.

FIG. 5B is a flowchart illustrating exemplary operation of an audio encoding device in performing the coding techniques described in this disclosure. The bitstream generation unit 42 of the audio encoding device 20 shown in the example of FIG. 3 may represent one example unit configured to perform the techniques described in this disclosure. The bitstream generation unit 42 may determine whether the quantization mode of the frame is the same as the quantization mode of a temporally previous frame (which may be denoted as a "second frame") (314). Although described with respect to a previous frame, the techniques may be performed with respect to temporally subsequent frames.

The frame may include a portion of one or more transport channels. The portion of the transport channel may include a Channel SideInfoData (formed in accordance with the ChannelSideInfoData syntax table) along with some payload (e.g., the VVectorData fields 156 in the example of FIG. 7). Other examples of payloads may include AddAmbientHOACoeffs fields.

When the quantization modes are the same ("YES" 316), the bitstream generation unit 42 may specify a portion of the quantization mode in the bitstream 21 (318). The portion of the quantization mode may include the bA syntax element and the bB syntax element but not the uintC syntax element. The bA syntax element may represent a bit indicative of the most significant bit of the NbitsQ syntax element. The bB syntax element may represent a bit indicative of the second most significant bit of the NbitsQ syntax element. The bitstream generation unit 42 may set the value of each of the bA syntax element and the bB syntax element to zero, thereby signaling that the quantization mode field in the bitstream 21 (i.e., the NbitsQ field as one example) does not include the uintC syntax element. This signaling of the zero value bA syntax element and the bB syntax element also indicates that the NbitsQ value, the PFlag value, the CbFlag value and the CodebkIdx value from the previous frame is to be used as the corresponding values for the same syntax elements of the current frame.

When the quantization modes are not the same ("NO" 316), the bitstream generation unit 42 may specify one or more bits indicative of the entire quantization mode in the bitstream 21 (320). That is, the bitstream generation unit 42 specifies the bA, bB and uintC syntax elements in the bitstream 21. The bitstream generation unit 42 may also specify quantization information based on the quantization mode (322). This quantization information may include any information related to quantization, such as the vector quantization information, the prediction information, and the Huffman codebook information. The vector quantization information may include, as one example, one or both of the CodebkIdx syntax element and the NumVecIndices syntax element. The prediction information may include, as one example, the PFlag syntax element. The Huffman codebook information may include, as one example, the CbFlag syntax element.

In this respect, the techniques may enable the audio encoding device 20 to be configured to obtain a bitstream 21 comprising a compressed version of a spatial component of a sound field. The spatial component may be generated by performing a vector based synthesis with respect to a plurality of spherical harmonic coefficients. The bitstream may further comprise an indicator for whether to reuse one or more bits of a header field, from a previous frame, that specifies information used when compressing the spatial component.

In other words, the techniques may enable the audio encoding device 20 to be configured to obtain a bitstream 21 comprising a vector 57 representative of an orthogonal spatial axis in a spherical harmonics domain. The bitstream 21 may further comprises an indicator (e.g., the bA/bB syntax elements of the NbitsQ syntax element) for whether to reuse, from a previous frame, at least one syntax element indicative of information used when compressing (e.g., quantizing) the vector.

Figure 6A:
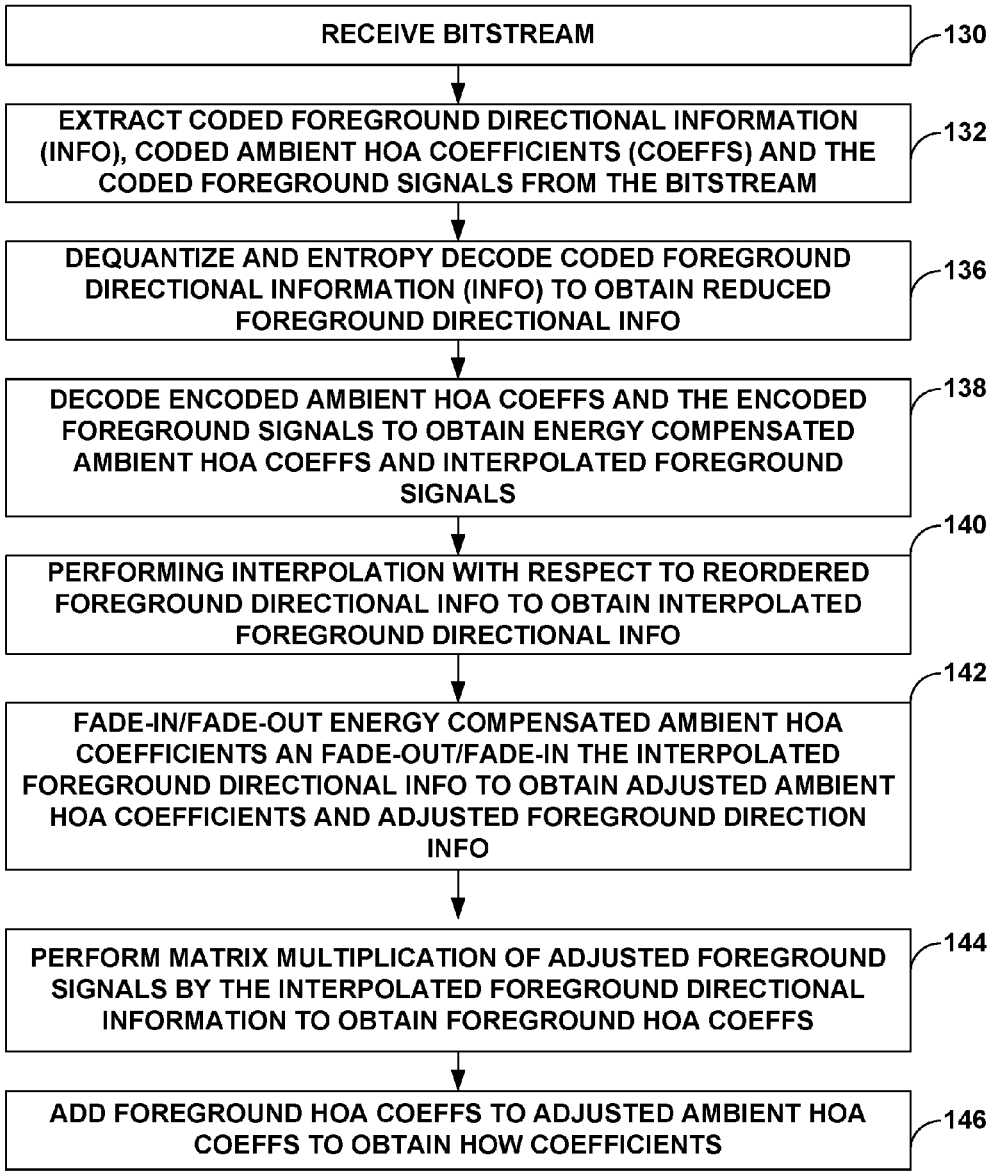
FIG. 6A is a flowchart illustrating exemplary operation of an audio decoding device in performing various aspects of the techniques described in this disclosure.

FIG. 6A is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $\mathbf{55}_k$ (136). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Figure 6B:
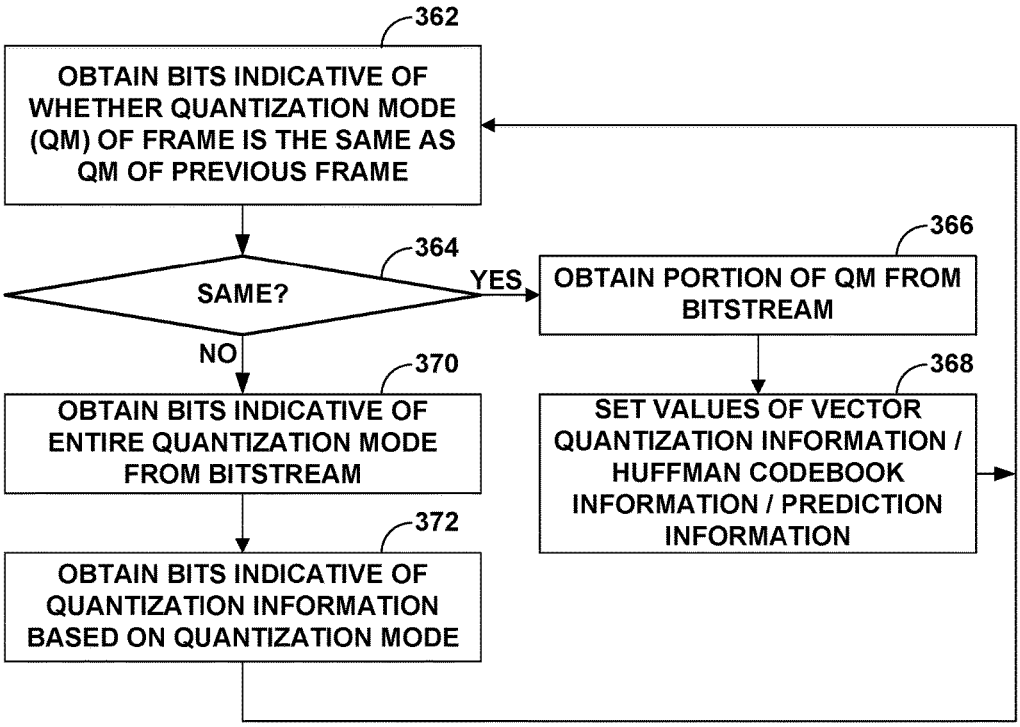
FIG. 6B is a flowchart illustrating exemplary operation of an audio decoding device in performing various aspects of the coding techniques described in this disclosure.

FIG. 6B is a flowchart illustrating exemplary operation of an audio decoding device in performing the coding techniques described in this disclosure. The extraction unit 72 of the audio encoding device 24 shown in the example of FIG. 4 may represent one example unit configured to perform the techniques described in this disclose. The bitstream extraction unit 72 may obtain bits indicative of whether the quantization mode of the frame is the same as the quantization mode of a temporally previous frame (which may be denoted as a "second frame") (362). Again, although described with respect to a previous frame, the techniques may be performed with respect to temporally subsequent frames.

When the quantization modes are the same ("YES" 364), the extraction unit 72 may obtain a portion of the quantization mode from the bitstream 21 (366). The portion of the quantization mode may include the bA syntax element and the bB syntax element but not the uintC syntax element. The extraction unit 42 may also set the values of the NbitsQ value, the PFlag value, the CbFlag value, the CodebkIdx value, and the NumVertIndices value for the current frame to be the same as the values of the NbitsQ value, the PFlag value, the CbFlag value, the CodebkIdx value, and the NumVertIndices value set for the previous frame (368).

When the quantization modes are not the same ("NO" 364), the extraction unit 72 may obtain one or more bits indicative of the entire quantization mode from the bitstream 21. That is, the extraction unit 72 obtains the bA, bB and uintC syntax elements from the bitstream 21 (370). The extraction unit 72 may also obtain one or more bits indicative of quantization information based on the quantization mode (372). As noted above with respect to FIG. 5B, the quantization information may include any information related to quantization, such as the vector quantization information, the prediction information, and the Huffman codebook information. The vector quantization information may include, as one example, one or both of the CodebkIdx syntax element and the NumVecIndices syntax element. The prediction information may include, as one example, the PFlag syntax element. The Huffman codebook information may include, as one example, the CbFlag syntax element.

In this respect, the techniques may enable the audio decoding device 24 to be configured to obtain a bitstream 21 comprising a compressed version of a spatial component of a sound field. The spatial component may be generated by performing a vector based synthesis with respect to a plurality of spherical harmonic coefficients. The bitstream may further comprise an indicator for whether to reuse one or more bits of a header field, from a previous frame, that specifies information used when compressing the spatial component.

In other words, the techniques may enable the audio decoding device 24 to be configured to obtain a bitstream 21 comprising a vector 57 representative of an orthogonal spatial axis in a spherical harmonics domain. The bitstream 21 may further comprises an indicator (e.g., the bA/bB syntax elements of the NbitsQ syntax element) for whether to reuse, from a previous frame, at least one syntax element indicative of information used when compressing (e.g., quantizing) the vector.

Figure 7:
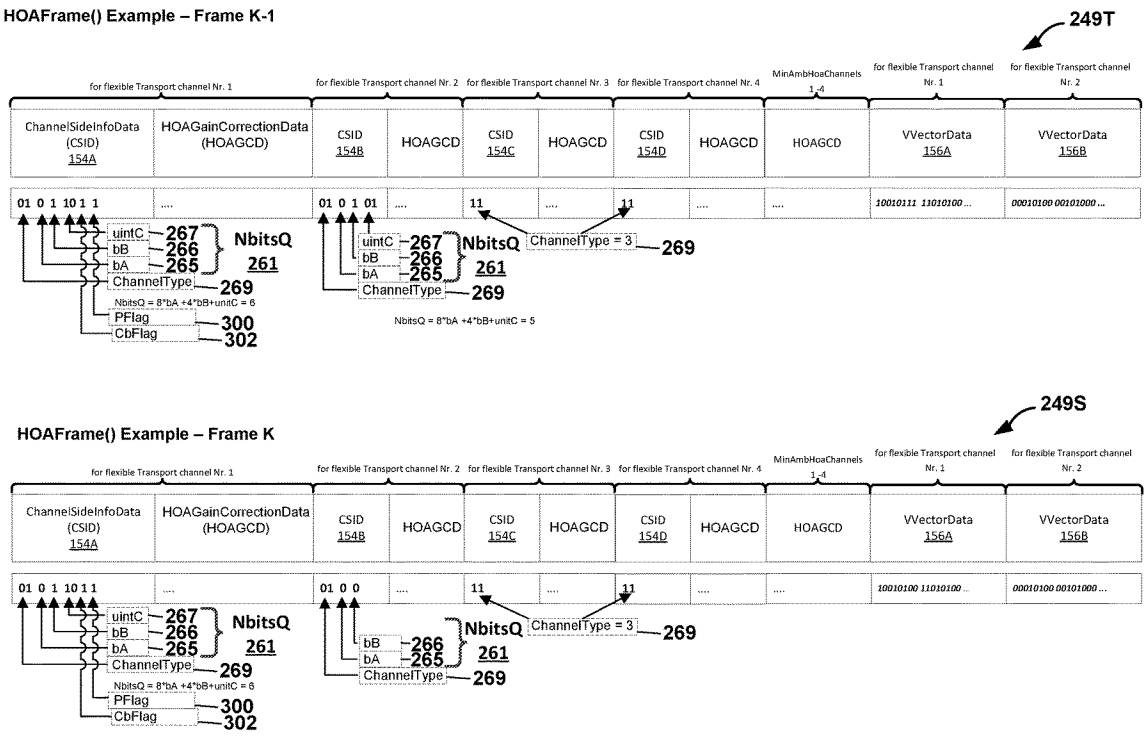
FIG. 7 is a diagram illustrating, in more detail, frames of the bitstream that may specify the compressed spatial components.

FIG. 7 is a diagram illustrating example frames 249S and 249T specified in accordance with various aspects of the techniques described in this disclosure. As shown in the example of FIG. 7, frame 249S includes ChannelSideInfoData (CSID) fields 154A-154D, HOAGainCorrectionData (HOAGCD) fields, VVectorData fields 156A and 156B and HOAPredictionInfo fields. The CSID field 154A includes a uintC syntax element ("uintC") 267 set to a value of 10, a bb syntax element ("bB") 266 set to a value of 1 and a bA syntax element ("bA") 265 set to a value of 0 along with a ChannelType syntax element ("ChannelType") 269 set to a value of 01.

The uintC syntax element 267, the bB syntax element 266 and the bA syntax element 265 together form the NbitsQ syntax element 261 with the bA syntax element 265 forming the most significant bit, the bB syntax element 266 forming the second most significant bit and the uintC syntax element 267 forming the least significant bits of the NbitsQ syntax element 261. The NbitsQ syntax element 261 may, as noted above, represent one or more bits indicative of a quantization mode (e.g., one of the vector quantization mode, scalar quantization without Huffman coding mode, and scalar quantization with Huffman coding mode) used to encode the higher-order ambisonic audio data.

The CSID syntax element 154A also includes a PFlag syntax element 300 and a CbFlag syntax element 302 referenced above in various syntax tables. The PFlag syntax element 300 may represent one or more bits indicative of whether a coded element of a spatial component of the soundfield represented by the HOA coefficients 11 (where again a spatial component may refer to the V-vector) of a first frame 249S is predicted from a second frame (e.g., a previous frame in this example). The CbFlag syntax element 302 may represent one or more bits indicative of a Huffman codebook information, which may identify which of the Huffman codebooks (or, in other words, tables) used to encode the elements of the spatial component (or, in other words, V-vector elements).

The CSID field 154B includes a bB syntax element 266 and a bB syntax element 265 along with the ChannelType syntax element 269, each of which are set to the corresponding values 0 and 0 and 01 in the example of FIG. 7. Each of the CSID fields 154C and 154D includes the ChannelType field 269 having a value of 3 ($11_2$). Each of the CSID fields 154A-154D corresponds to the respective one of the transport channels 1, 2, 3 and 4. In effect, each CSID field 154A-154D indicates whether a corresponding payload are direction-based signals (when the corresponding ChannelType is equal to zero), vector-based signals (when the corresponding ChannelType is equal to one), an additional Ambient HOA coefficient (when the corresponding ChannelType is equal to two), or empty (when the ChannelType is equal to three).

In the example of FIG. 7, the frame 249S includes two vector-based signals (given the ChannelType syntax elements 269 being equal to 1 in the CSID fields 154A and 154B) and two empty (given the ChannelType 269 equal to 3 in the CSID fields 154C and 154D). Moreover, the audio encoding device 20 employed predication as indicated by the PFlag syntax element 300 being set to one. Again, prediction as indicated by the PFlag syntax element 300 refers to a prediction mode indication indicative of whether prediction was performed with respect to the corresponding one of the compressed spatial components v1-vn. When the PFlag syntax element 300 is set to one the audio encoding device 20 may employ prediction by taking a difference between, for scalar quantization, a vector element from a previous frame with the corresponding vector element of the current frame or, for vector quantization, a different between a weight from a previous frame with a correspond weight of the current frame.

The audio encoding device 20 also determined that the value for the NbitsQ syntax element 261 for the CSID field 154B of the second transport channel in the frame 249S is the same as the value of the NbitsQ syntax element 261 for the CSID field 154B of the second transport channel of the previous frame, e.g. frame 249T in the example of FIG. 7. As a result, the audio encoding device 20 specified a value of zero for each of bA syntax element 265 and the bB syntax element 266 to signal that the value of the NbitsQ syntax element 261 of the second transport channel in the previous frame 249T is reused for the NbitsQ syntax element 261 of the second transport channel in the frame 249S. As a result, the audio encoding device 20 may avoid specifying the uintC syntax element 267 for the second transport channel in the frame 249S along with the other syntax element identified above.

Figure 8:
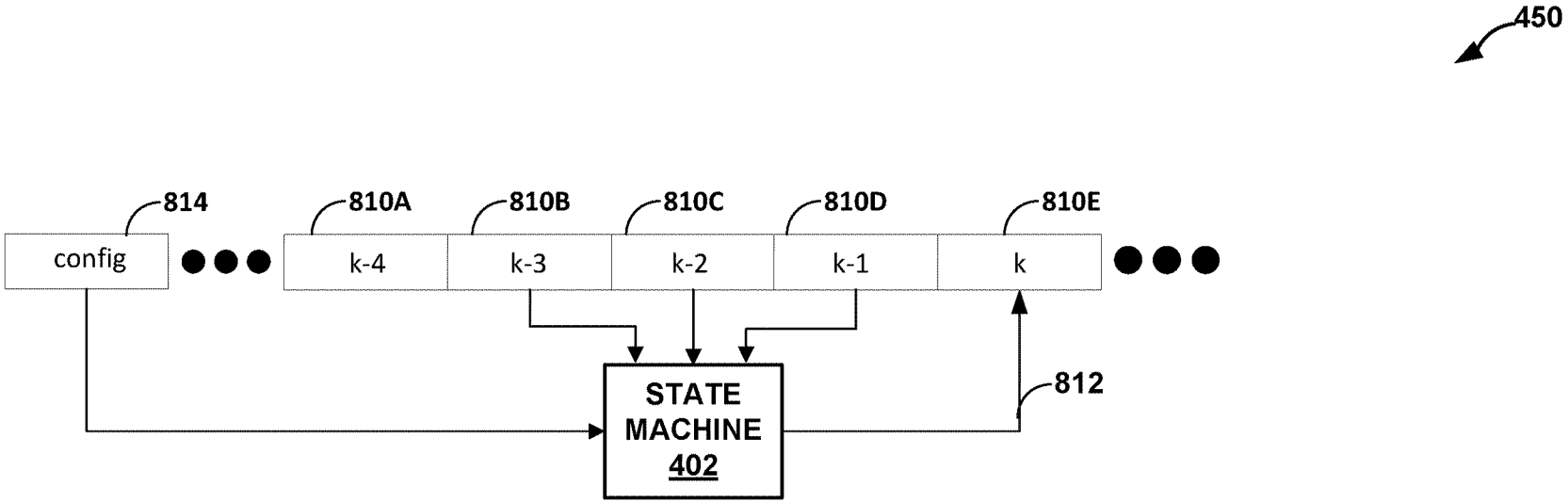
FIG. 8 is a diagram illustrating a portion of the bitstream that may specify the compressed spatial components in more detail.

FIG. 8 is a diagram illustrating example frames for one or more channels of at least one bitstream in accordance with techniques described herein. The bitstream 450 includes frames 810A-810H that may each include one or more channels. The bitstream 450 may be one example of the bitstream 21 shown in the example of FIG. 7. In the example of FIG. 8, the audio decoding device 24 maintains state information, updating the state information to determine how to decode the current frame k. The audio decoding device 24 may utilize state information from config 814, and frames 810B-810D.

In other words, the audio encoding device 20 may include, within the bitstream generation unit 42 for example, the state machine 402 that maintains state information for encoding each of frames 810A-810E in that the bitstream generation unit 42 may specify syntax elements for each of frames 810A-810E based on the state machine 402.

The audio decoding device 24 may likewise include, within the bitstream extraction unit 72 for example, a similar state machine 402 that outputs syntax elements (some of which are not explicitly specified in the bitstream 21) based on the state machine 402. The state machine 402 of the audio decoding device 24 may operate in a manner similar to that of the state machine 402 of the audio encoding device 20. As such, the state machine 402 of the audio decoding device 24 may maintain state information, updating the state information based on the config 814 and, in the example of FIG. 8, the decoding of the frames 810B-810D. Based on the state information, the bitstream extraction unit 72 may extract the frame 810E based on the state information maintained by the state machine 402. The state information may provide a number of implicit syntax elements that the audio encoding device 20 may utilize when decoding the various transport channels of the frame 810E.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yyet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device for processing a bitstream, the device comprising:

one or more processors configured to obtain the bitstream, the bitstream comprising a compressed version of a spatial component of a sound field, the spatial component of the sound field being represented by a vector in a spherical harmonics domain, wherein a value of a syntax element for a current frame is indicative of a vector quantization codebook used when compressing the vector, the bitstream further comprising an indicator, the indicator having a particular value indicating the bitstream does not include the value of the syntax element for the current frame and the value of the syntax element for the current frame is equal to a value of the syntax element for a previous frame; and a memory coupled to the one or more processors, the memory configured to store the bitstream.

2. The device of claim 1, wherein the one or more processors are further configured to use the vector quantization codebook to reconstruct the vector.

3. The device of claim 1, wherein the syntax element is a first syntax element and the indicator comprises one or more bits of a value of a second syntax element for the current frame, the value of the second syntax element for the current frame indicating a quantization mode used when compressing the vector.

4. The device of claim 3, wherein:

the indicator comprises a value of a third syntax element for the current frame and a value of a fourth syntax element for the current frame, and the value of the third syntax element for the current frame plus the value of the fourth syntax element for the current frame being equal to zero indicates the bitstream does not include the value of the first syntax element for the current frame and the value of the first syntax element for the current frame is equal to the value of the first syntax element for the previous frame.

5. The device of claim 3, wherein the indicator includes a most significant bit of the value of the second syntax element for the current frame and a second most significant bit of the value of the second syntax element for the current frame.

6. The device of claim 1, the one or more processors further configured to:

decompose higher-order ambisonic audio data to obtain the vector; and specify the vector in the bitstream to obtain the bitstream.

7. The device of claim 1, the one or more processors further configured to:

obtain, from the bitstream, an audio object that corresponds to the vector; and combine the audio object with the vector to reconstruct higher-order ambisonic (HOA) audio data.

8. The device of claim 1, wherein:

the one or more processors are configured to render the HOA audio data to output one or more loudspeaker feeds, the device is coupled to one or more loudspeakers, wherein the one or more loudspeaker feeds drive the one or more loudspeakers.

9. The device of claim 1, wherein the one or more processors are further configured to:

obtain the value of the syntax element for the current frame from the bitstream when the indicator does not have the particular value.

10. A method for processing a bitstream, the method comprising:

obtaining the bitstream, the bitstream comprising a compressed version of a spatial component of a sound field, the spatial component of the sound field being represented by a vector in a spherical harmonics domain, wherein a value of a syntax element for a current frame is indicative of a vector quantization codebook used when compressing the vector, the bitstream further comprising an indicator, the indicator having a particular value indicating the bitstream does not include the value of the syntax element for the current frame and the value of the syntax element for the current frame is equal to a value of the syntax element for a previous frame; and storing the bitstream.

11. The method of claim 10, further comprising using the vector quantization codebook to reconstruct the vector.

12. The method of claim 10, wherein the syntax element is a first syntax element and the indicator comprises one or more bits of a value of a second syntax element for the current frame, the value of the second syntax element for the current frame indicating a quantization mode used when compressing the vector.

13. The method of claim 12, wherein:

the indicator comprises a value of a third syntax element for the current frame and a value of a fourth syntax element for the current frame, and the value of the third syntax element for the current frame plus the value of the fourth syntax element for the current frame being equal to zero indicates the bitstream does not include the value of the first syntax element for the current frame and the value of the first syntax element for the current frame is equal to the value of the first syntax element for the previous frame.

14. The method of claim 12, wherein the indicator includes a most significant bit of the value of the second syntax element for the current frame and a second most significant bit of the value of the second syntax element for the current frame.

15. The method of claim 10, further comprising:

decomposing higher-order ambisonic audio data to obtain the vector; and specifying the vector in the bitstream to obtain the bitstream.

16. The method of claim 10, further comprising:

obtaining, from the bitstream, an audio object that corresponds to the vector; and combining the audio object with the vector to reconstruct higher-order ambisonic audio data.

17. The method of claim 10, further comprising:

decoding the bitstream to obtain Higher Order Ambisonics (HOA) coefficients; and rendering the HOA coefficients to output one or more loudspeaker feeds, a device rendering the HOA coefficients to output the one or more loudspeaker feeds is coupled to one or more loudspeakers, wherein the one or more loudspeaker feeds drive the one or more loudspeakers.

18. The method of claim 10, further comprising:

obtaining the value of the syntax element for the current frame from the bitstream when the indicator does not have the particular value.

19. A device for processing a bitstream, the device comprising:

means for obtaining the bitstream, the bitstream comprising a compressed version of a spatial component of a sound field, the spatial component of the sound field being represented by a vector in a spherical harmonics domain, wherein a value of a syntax element for a current frame is indicative of a vector quantization codebook used when compressing the vector, the bitstream further comprising an indicator, the indicator having a particular value indicating the bitstream does not include the value of the syntax element for the current frame and the value of the syntax element for the current frame is equal to a value of the syntax element for a previous frame; and means for storing the bitstream.

20. The device of claim 19, further comprising: means for using the vector quantization codebook to reconstruct the vector.

21. The device of claim 19, wherein the syntax element is a first syntax element and the indicator comprises one or more bits of a value of a second syntax element for the current frame, the value of the second syntax element for the current frame indicating a quantization mode used when compressing the vector.

22. The device of claim 19, further comprising:

means for decomposing higher-order ambisonic audio data to obtain the vector; and means for specifying the vector in the bitstream to obtain the bitstream.

23. The device of claim 19, the device further comprising:

means for obtaining the value of the syntax element for the current frame from the bitstream when the indicator does not have the particular value.

24. A non-transitory computer-readable storage medium having instructions stored thereon that, when executed, configure a device to:

obtain a bitstream, the bitstream comprising a compressed version of a spatial component of a sound field, the spatial component of the sound field being represented by a vector in a spherical harmonics domain, wherein a value of a syntax element for a current frame is indicative of a vector quantization codebook used when compressing the vector, the bitstream further comprising an indicator, the indicator having a particular value indicating the bitstream does not include the value of the syntax element for the current frame and the value of the syntax element for the current frame is equal to a value of the syntax element for a previous frame; and store the bitstream.

25. The non-transitory computer-readable storage medium of claim 24, wherein the instructions, when executed, configure the device to use the vector quantization codebook to reconstruct the vector.

26. The non-transitory computer-readable storage medium of claim 24, wherein the syntax element is a first syntax element and the indicator comprises one or more bits of a value of a second syntax element for the current frame, the value of the second syntax element for the current frame indicating a quantization mode used when compressing the vector.

27. The non-transitory computer-readable storage medium of claim 24, wherein the instructions, when executed, cause the device to:

decompose higher-order ambisonic audio data to obtain the vector; and specify the vector in the bitstream to obtain the bitstream.

28. The non-transitory computer-readable storage medium of claim 24, wherein the instructions, when executed, cause the device to:

obtain the value of the syntax element for the current frame from the bitstream when the indicator does not have the particular value.

* * * * *